US006192609B1

(12) United States Patent
Alvern

(10) Patent No.: US 6,192,609 B1
(45) **Date of Patent: *Feb. 27, 2001**

(54) DISPLAY APPARATUS

(75) Inventor: Stein Alvern, Oslo (NO)

(73) Assignee: Alvern-Norway, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/098,464

(22) Filed: Jun. 17, 1998

Related U.S. Application Data

(60) Division of application No. 08/610,961, filed on Mar. 5, 1996, now Pat. No. 5,806,217, which is a continuation-in-part of application No. 08/590,407, filed on Jan. 25, 1996, now Pat. No. 5,864,975.

(51) Int. Cl.[7] ..... B67D 5/00
(52) U.S. Cl. ..... 40/299.01; 141/98; 222/23
(58) Field of Search ..... 40/299, 661, 611, 40/299.01; 222/23, 29; 141/392, 98, 206

(56) References Cited

U.S. PATENT DOCUMENTS

| | | |
|---|---|---|
| D. 173,006 | 9/1954 | Anderson . |
| D. 173,007 | 9/1954 | Anderson . |
| D. 279,483 | 7/1985 | Goldman . |
| D. 279,484 | 7/1985 | Goldman . |
| D. 366,310 | 1/1996 | Fell . |
| 1,350,275 | 8/1920 | Gafinowitz . |
| 1,636,500 | 7/1927 | Cox . |

(List continued on next page.)

FOREIGN PATENT DOCUMENTS

| | | |
|---|---|---|
| 44276 | 12/1962 | (AU) . |
| 113952 | 5/1992 | (AU) . |
| 114881 | 8/1992 | (AU) . |
| 122642 | 2/1995 | (AU) . |
| 123343 | 5/1995 | (AU) . |
| 550516 | 12/1957 | (CA) . |
| 0 407 271 A1 | 1/1991 | (EP) . |
| 0 476 303 A1 | 3/1992 | (EP) . |
| 0 608 596 A1 | 8/1994 | (EP) . |
| 892244 | 3/1962 | (GB) . |
| 980890 | 1/1965 | (GB) . |
| 1 393 062 | 5/1975 | (GB) . |
| 2 147 273 | 5/1985 | (GB) . |
| 62-208396 | 9/1987 | (JP) . |
| 850627 | 10/1992 | (JP) . |
| WO 90/08375 | 7/1990 | (WO) . |
| WO 93/15493 | 8/1993 | (WO) . |

*Primary Examiner*—Cassandra H. Davis
(74) *Attorney, Agent, or Firm*—Finnegan Henderson Farabow Garrett & Dunner, L.L.P.

(57) ABSTRACT

Display apparatus is removably attachable to the filler gun of a fuel pump, the filler gun including in series connection a gun nozzle having a forward discharge end and a rear end, a gun head having both a forward end portion which connects with the rear end of the gun nozzle and a rearward handle portion whose forward end connects to the rear of the gun nozzle and a rearward handle portion whose forward end connects to the rear end of said gun head. The display apparatus comprises a carrying body adapted to be fitted onto the fillers gun and to extend from approximately a first junction between the rear end of the gun nozzle and the forward end of the gun head to approximately a second junction between the rear end of the gun head and the forward end of the handle, the carrying body having an upper surface defining an elongate display surface for messages, and comprising a first member and a second member and structure for releasably interconnecting the first and second members, the first and second members being shaped to generally conform, when so interconnected, to enclose the sides, bottom, and upper portions of the gun head, and structure pivotally connected to the upper surface of the carrying body for supporting a replaceable message card placed on the display surface.

5 Claims, 20 Drawing Sheets

U.S. PATENT DOCUMENTS

| | | |
|---|---|---|
| 1,729,961 | 10/1929 | Partridge . |
| 1,970,798 | 8/1934 | Daly et al. . |
| 2,066,877 | 1/1937 | Cruver . |
| 2,295,468 | 9/1942 | Haley . |
| 2,800,931 | 7/1957 | Sutcliffe . |
| 2,823,479 | 2/1958 | Zdanowski . |
| 3,291,165 | 12/1966 | Fraylick . |
| 3,337,976 | 8/1967 | Winger et al. . |
| 3,474,837 | 10/1969 | Carder et al. . |
| 3,902,630 | 9/1975 | Knize . |
| 4,010,781 | 3/1977 | Sutcliffe . |
| 4,073,612 | 2/1978 | Nitta . |
| 4,165,572 | 8/1979 | Sussman . |
| 4,268,986 | 5/1981 | Piana . |
| 4,275,518 | 6/1981 | Martin . |
| 4,275,815 | 6/1981 | Davis . |
| 4,292,749 | 10/1981 | Thomas . |
| 4,351,375 | 9/1982 | Polson . |
| 4,408,791 | 10/1983 | Griffin et al. . |
| 4,453,325 | 6/1984 | Ofsowitz et al. . |
| 4,465,209 | 4/1984 | Wilder . |
| 4,545,140 | 10/1985 | Winston . |
| 4,593,792 | 6/1986 | Tamra . |
| 4,690,182 | 9/1987 | Knaus . |
| 4,730,649 | 3/1988 | Matsumura et al. . |
| 4,848,117 | 7/1989 | Welborn et al. . |
| 4,934,419 | 6/1990 | Lamont et al. . |
| 5,058,637 | 10/1991 | Fell . |
| 5,184,309 | 2/1993 | Simpson et al. . |
| 5,184,655 | 2/1993 | Fell . |

FIG. 19
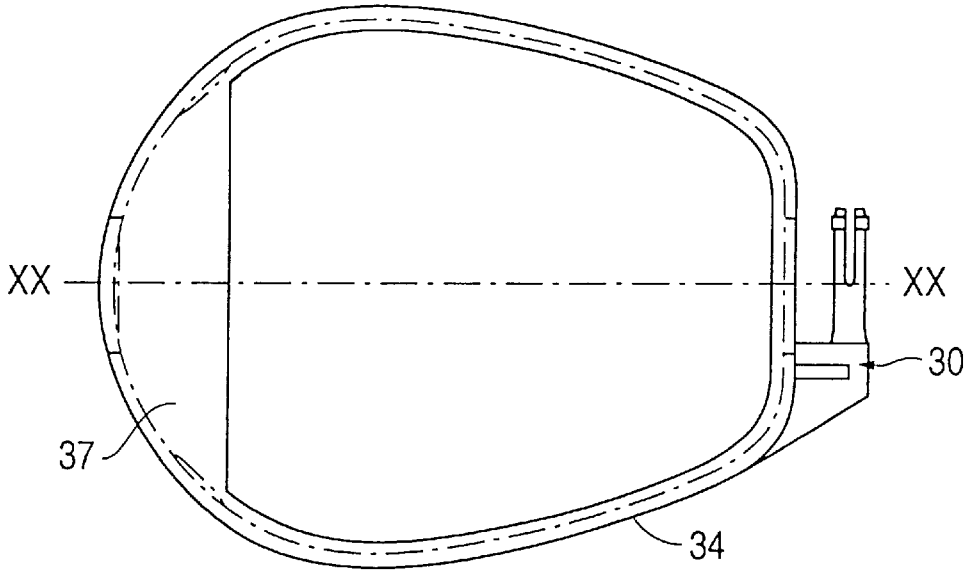
FIG. 20
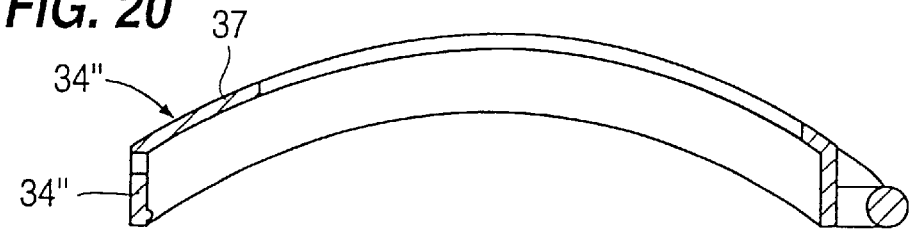
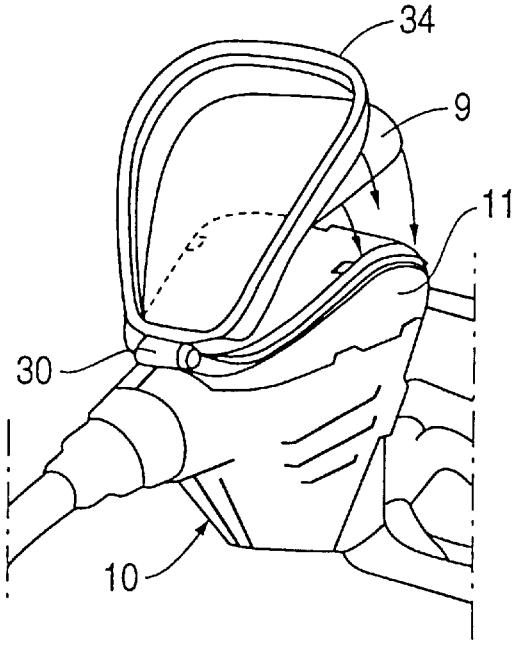
FIG. 21
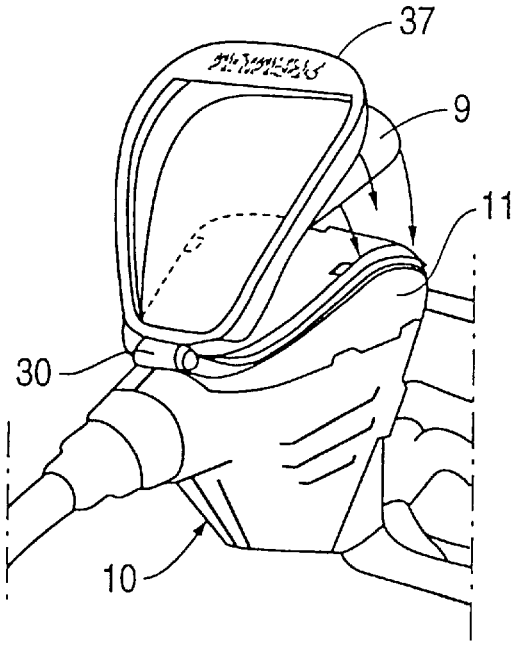
FIG. 22

DISPLAY APPARATUS

This is a division of application Ser. No. 08/610,961, filed Mar. 5, 1996 now U.S. Pat. No. 5,806,217, which is a CIP of Ser. No. 08/590,407, filed Jan. 25, 1996 now U.S. Pat. No. 5,864,975 all of which are incorporated herein by reference.

BACKGROUND OF THE INVENTION

1. Field of the Invention

The present invention relates to a display apparatus removably attachable to the filler gun of a fuel pump. The filler gun includes, in series connection, (a) a nozzle having a forward discharge end and a rear end, (b) a gun head having a forward end portion which connects with the rear end of the nozzle, and (c) a rearward handle portion whose forward end connects to the rear end of the gun head. The display apparatus comprises a carrying body adapted to be fitted onto the filler gun and to extend from approximately a first junction between the rear end of the gun nozzle and the forward end of the gun head to approximately a second junction between the rear end of the gun head and the forward end of the handle. The carrying body has an upper surface defining an elongate display surface for messages. The display apparatus of the present invention is also useful on a filler gun having its gun head covered by a protective boot of rubber or plastic material.

2. Description of the Related Art

The related art discloses a carrying body of the above mentioned type with the carrying body being shaped like a boot and having a rear end which is fully open to permit entry of the filler gun nozzle and the gun head, and a front end with a substantially smaller opening through which the filler gun nozzle protrudes when the carrying body is fitted onto the filler gun. A carrying body of such type has an upper surface which effectively covers the upper region of the gun head to thereby define the elongate display surface for messages. Such carrying bodies are suitable for use in countries having only a very limited number of filler gun types as, for example, in Norway, Denmark, Germany and Sweden. However, in other areas of the world, the number of differently designed filler guns may be substantially higher. In the United States of America, for example, the number of differently shaped filler guns is in excess of ten. Such a large number of different types of filler guns ordinarily requires a large number of differently dimensioned carrying bodies. In such situations, it is difficult to provide the same display surface area and configuration for each carrying body type. This is disadvantageous because it prohibits use of a size and configuration of an advertising display card or the like to be used in a maximum number of different filler guns. Also, some filler guns are so designed that it is difficult to design an easily fitted and removable carrying body.

SUMMARY OF THE INVENTION

It is highly desirable to have a carrying body which is easily attachable to the filler gun even by an inexperienced person, and also to have a carrying body which is easily removable from the filler gun when maintenance is to be carried out on the filler gun, e.g. repair of fuel valve means within the filler gun head.

Most filler guns are known to have a gun head covered by a protective boot of rubber or plastic material, both for protecting the gun head against damage and to prevent a bare gun head from making scratches on a car's paint work.

Removing such protective boot from a filler gun in order to replace it with a carrying body according to the present invention is both time consuming, implying a waste of such boot material, and because the gun head is then less protected. The present invention therefore also includes the feature of being able to be fit onto a filler gun a carrying body according to the present invention without having to remove such protective boot.

According to a first embodiment of the present invention, the carrying body comprises a first member and a second member and means for releasably interconnecting the first and second members, the first and second members being shaped to generally conform, when so interconnected, to enclose the side, bottom, and upper portions of the gun head; and means pivotally connected to a top surface of the carrying body for supporting a replaceable message card placed on the display surface of the first member.

According to another embodiment of the present display apparatus, the carrying body comprises a lower member and an upper member releasably engageable with the lower member, the lower member having two side panels and means for interconnecting the side panels. The lower member, when the two side panels are brought to lie against the gun head, substantially fitting around the lower part of the gun head. The side panels may have at their top region a first interlocking means, the upper member being formed as a cap-like member to fit over an upper part of the gun head, and having a second interlocking means for releasably engaging the first interlocking means on the lower member, and a top member releasably engageable with the upper member. The top member has means for releasable engagement with the upper member, space being provided between an upper surface of the upper member and a portion of the top member for locating a replaceable message card when the top member and the upper member engage.

When the filler gun head is of the type already covered by a protective boot of rubber of plastic material, the carrying body can be fitted on the filler gun without having to remove the protective boot.

In a further embodiment of the display apparatus, the carrying body comprises a lower member and an upper member releasably engageable with the lower member, and further a top member which is releasably engageable with the upper member. The top member has a curved configuration along its length.

According to still a further embodiment of the display apparatus, the carrying body may comprise a lower member, an upper member releasably engageable with the lower member, the lower member having two side panels, and means for interconnecting the side panels. The lower member, when the two side panels are brought to lie against the gun head, substantially surrounds a lower part of the gun head. The side panels have at their top regions a first interlocking means, and the upper member being formed as a cap-like means to fit over an upper part of the gun head, and also have a second interlocking means for releasable engaging the first interlocking means onto the lower member. The upper member may have an upper (top) surface for locating a replaceable message card, the upper surface having along at least a portion of its peripheral edge an upwardly extending rim and means protruding upwardly from the upper (top) surface for releasably engaging holes in the message card. This latter embodiment is also useful on a filler gun which has its gun head covered by a protective boot, because there is no need to remove the protective boot before fitting the carrying body onto the filler gun.

According to the invention, it is also possible to provide a carrying body comprising a lower member, and an upper member releasably engageable with the lower member, the upper member having a top surface with a curved configuration along its length.

Although in a preferred embodiment of the present invention the two side panels are brought towards each other to lie against opposite sides of the gun head, it is possible, with a choice of suitable material for the lower member, to have the two side panels integrally joined at a front region thereof. Such a variant may be useful in order to provide typical male/female elements for matching and joining front region edges of the two side panels.

In another preferred embodiment of the present invention, the two side panels are suitably made as a two separate panels which are provided with interconnecting means, such as a snap-lock means.

Contrary to the prior art carrying body, the carrying body of the present invention is made of a substantially hard plastic material e.g. polyamide. The pivotally connected member or top member is also suitably made of a substantially hard plastic material, e.g. polycarbonate.

If the carrying body is provided with a pivotally connected top member, such member can be a lid with a transparent face portion for viewing a message therethrough, or a frame with an open space between opposite sides of the frame. In the case of a frame, the frame can be made of a transparent or non-transparent material, for example, polycarbonate, and the color thereof could be e.g. the same color as that of the carrying body, or a color forming a typical contrast to the color of the carrying body. Also, such frame could have a portion carrying information related to the type of fuel supplied from the gun. Further, in order to more easily detach the frame from the upper member, the upper member may at a peripheral region adjacent to a corresponding portion of the frame have a transverse dimension which is less than a transverse dimension of the frame.

These, and further, embodiments of the display apparatus according to the present invention will appear from the description below with reference to the attached drawing figures, as well as the attached patent claims.

BRIEF DESCRIPTION OF THE DRAWINGS

The present invention is now to be described with reference to the attached drawing figures illustrating preferred, but non-limitative embodiments of the present invention.

FIG. 19 shows a top plan view of a modification of the top member of FIG. 16, FIG. 20 is cross section XX—XX of FIG. 19;

FIG. 21 illustrates in a perspective view the display apparatus installed on a fuel gun with a top member according to FIG. 16;

FIG. 22 shows in perspective view a display apparatus according to the present invention installed on a filler gun and with a top member according to FIG. 19;

DETAILED DESCRIPTION OF THE PREFERRED EMBODIMENTS

Figure 1:
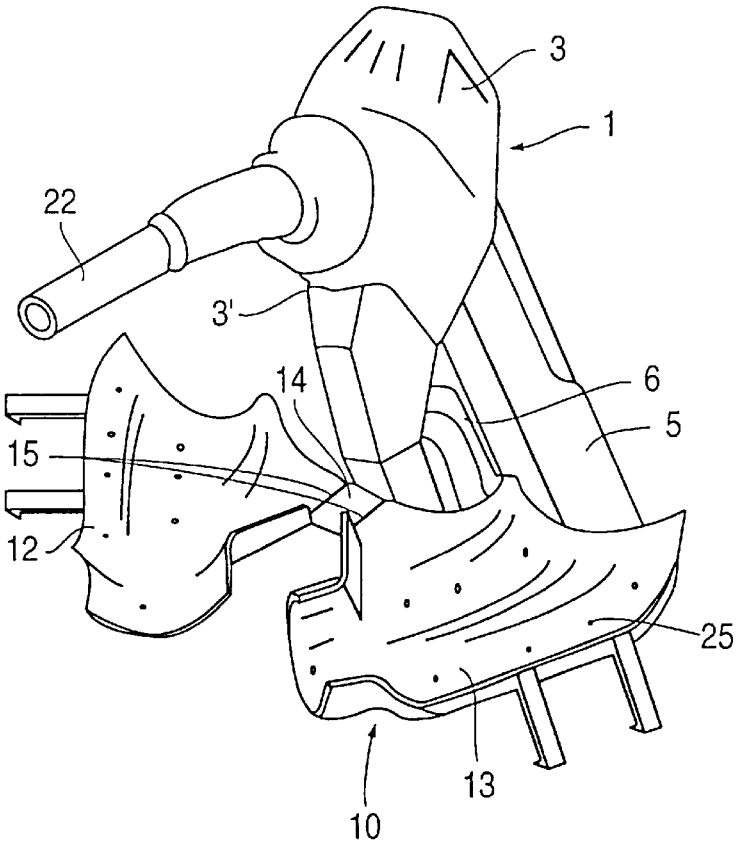
FIGS. 1 and 2 illustrate fitting of a lower member of the carrying body of the present invention onto a filler gun head.
Figure 2:
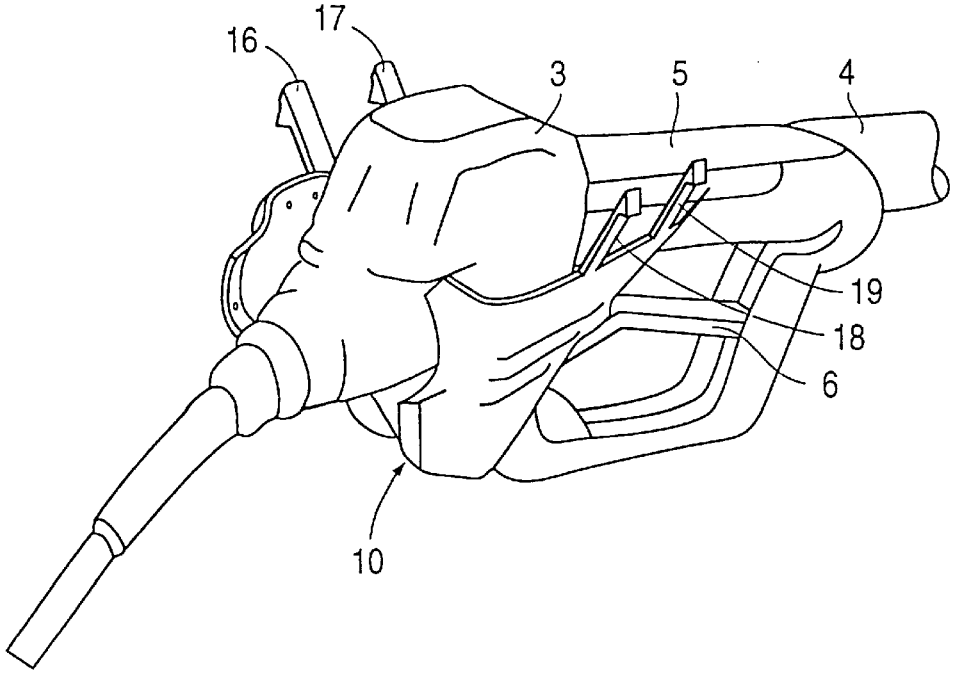

FIGS. 1 and 2 show a filler gun 1 of a fuel pump. The filler gun includes a fuel gun nozzle 2 for discharging fuel at its front end and a gun head 3 having internally located fuel valve means (not shown). The valve outlet means communicates with the nozzle 2, and valve inlet means (not shown) communicates with fuel supply means connected to a fuel hose 4, the fuel supply means extending through a handle 5 of the gun. The handle 5 has lever means 6 which are operatively connected to the valve means. The gun head 3 may be of an unprotected type, or may be covered by a protective boot of rubber or plastic material as indicated by reference number 3'.

Figure 4:
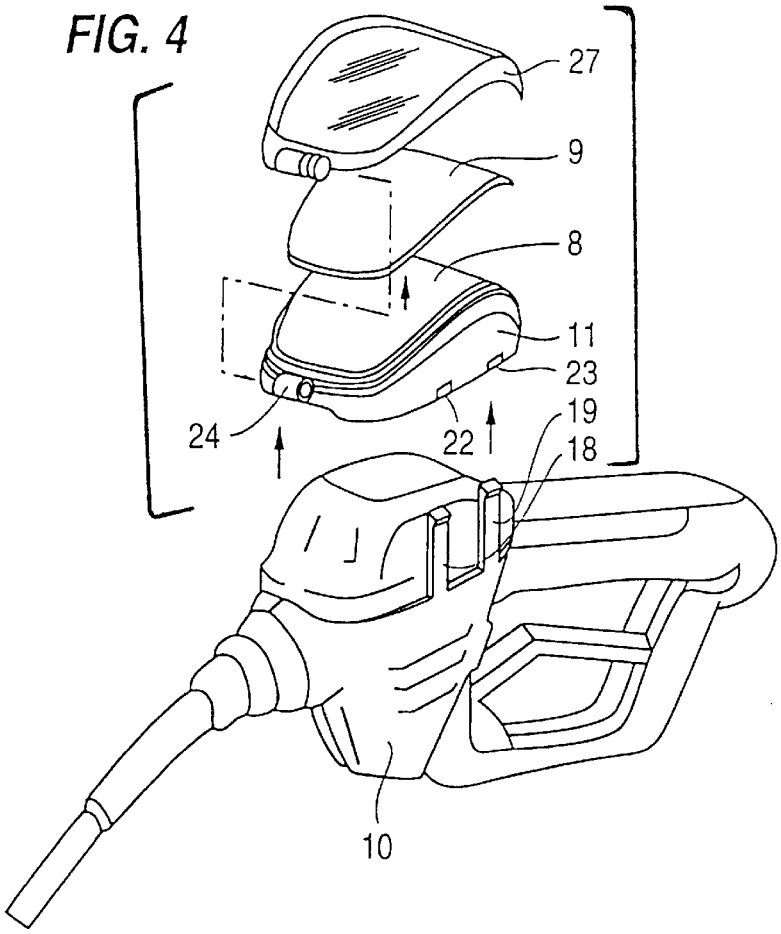
FIG. 4 further illustrates mounting of the upper member onto the filler gun and with pivotable engagement of a top member with the upper member.
Figure 5:
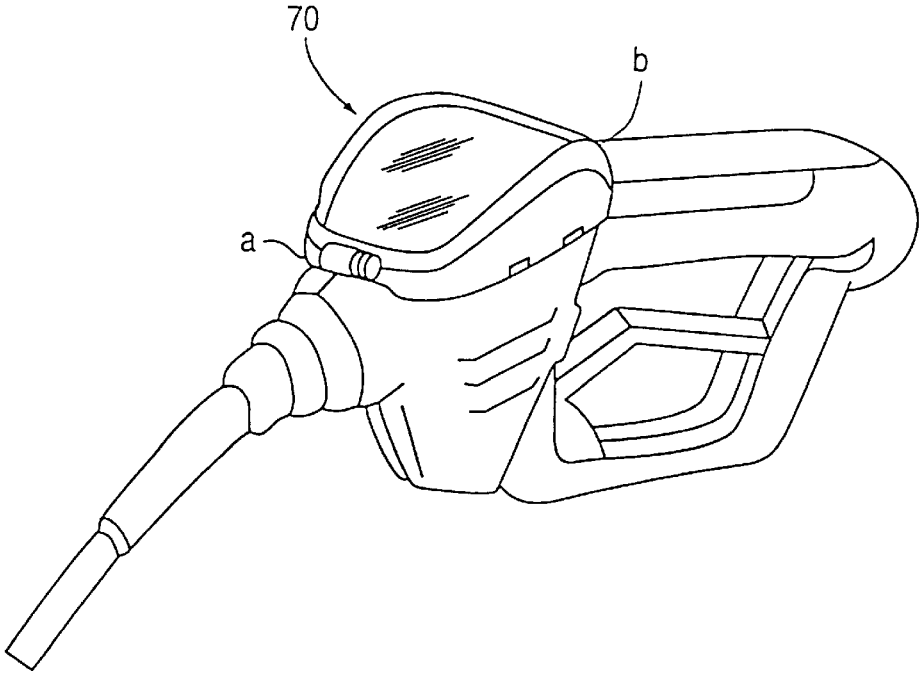
FIG. 5 shows a carrying body with the top member fully installed on the filler gun.

As shown in FIGS. 4 and 5, the filler gun is provided with a display apparatus, generally denoted by reference number 70. Such display apparatus is intended for supporting on its upper surface 8 a message card 9 for displaying a graphic message readily viewable by a filler gun user.

As clearly shown in FIGS. 4 and 5, the carrying body 7 for the graphic message is adapted to fit over the filler gun to extend from approximately the junction "a" of the gun nozzle 2 with the gun head 3 to approximately the junction "b" of the gun head 3 with a forward end of the handle 5. The display surface 8 for the graphic message, when the carrying body 7 is attached to the filler gun, also extends longitudinally along the filler gun from approximately the junction "a" of the gun head 3 with the nozzle 2 to approximately the junction "b" of the gun head with a forward end of the handle of the gun.

As clearly seen from FIGS. 1–5, the carrying body 7 comprises a lower member 10 and an upper member 11 releasably engageable with the lower member 10. The lower member 10 has two side panels 12, 13, a bottom element 14 and means 15, such as film hinges or other transition means, integrally connecting side panels 12, 13 with the bottom element 14. As shown in FIG. 2, the lower member 10 with its side panels 12, 13 and bottom element 14 are brought to lie against the gun head 3 substantially fitting around a lower part of the gun head. At the top region of the side panels there are first interlocking means 16, 17 and 18, 9 on the respective panels 12 and 13. The first interlocking means 16–19 are suitably formed as male elements in the form of snap hooks.

Figure 3:
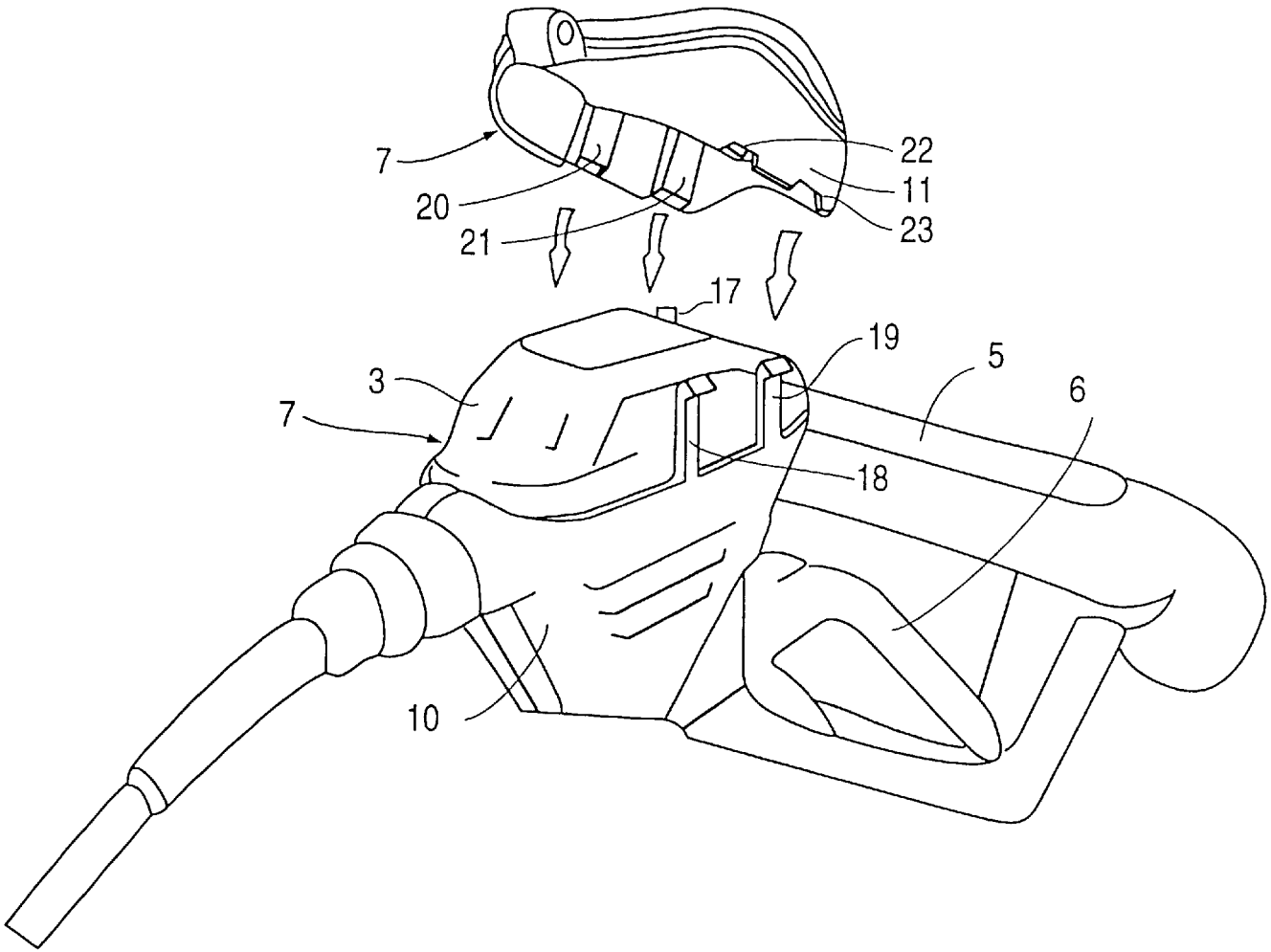
FIG. 3 illustrates fitting of an upper member of the carrying body onto the filler gun head through engagement with the lower member.
Figure 10:
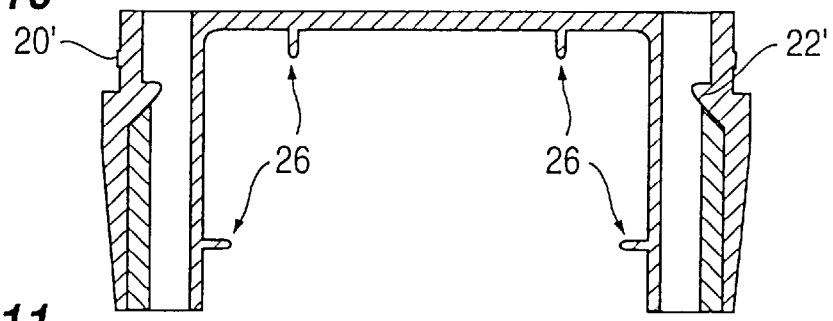
Figure 11:
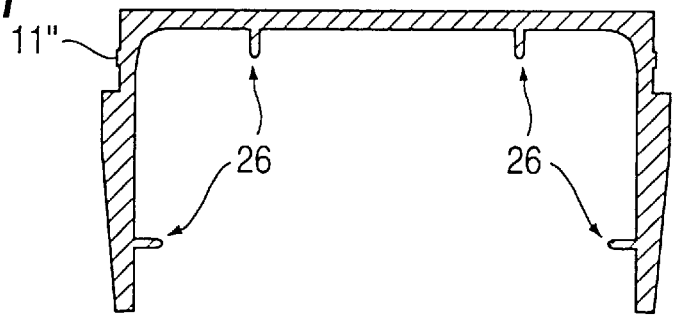

As seen from FIGS. 3 and 4, the upper member 11 is formed as a cap-like means to fit over an upper part of the gun head 3. The upper member 11 has second interlocking means 20, 21 and 22, 23 for releasably engaging the first interlocking means 16, 17 and 18, 19, respectively, on the lower member. The second interlocking means are formed as female elements having means, e.g. in the form of a ledge or set-off 20', 21', 22', 23' as indicated more closely in FIGS. 7, 8 and 10. FIG. 1 shows that the panels 12, 13, the bottom element 14, the connecting means 15 and the first interlocking means 16–13 are formed as an integrally made structure, e.g. through an injection molding process.

Figure 14:
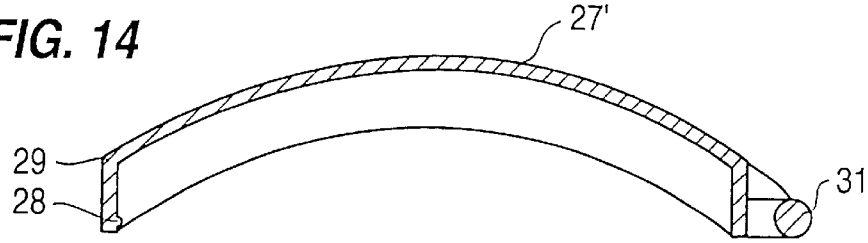
FIG. 14 is section XIV—XIV of FIG. 13.
Figure 15:
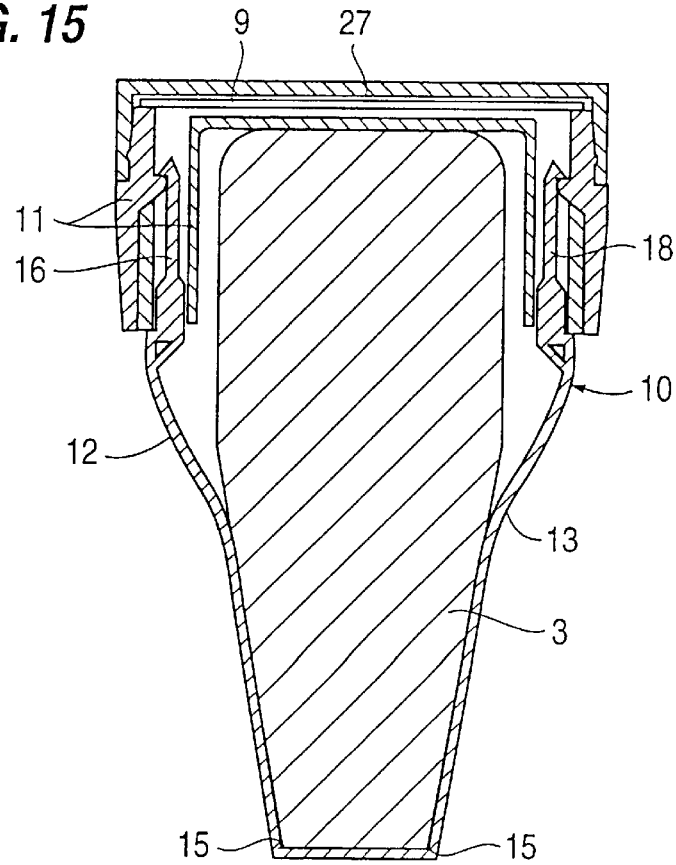
FIG. 15 is a cross section through the display apparatus with the top member of FIG. 13 and installed on a filler gun.

As seen from FIG. 6, the upper member 11 has an upper peripheral portion 11' with a bead 11" extending along the upper peripheral portion 11' for releasably engaging a peripheral skirt portion of a top member to be located on the upper member 11, as will be explained further with reference to FIGS. 13–15.

At a forward end of the upper member, there is provided a first hinge means 24 in the form of a protruding member having a transverse hole 24'.

As illustrated in FIGS. 1 and 2, side panels 12, 13 may be provided with a plurality of integrally made studs 25 which are both for compensating for any tolerances in the space between the panels 12, 13 and the gun head 3 as well as being able to penetrate partly into any protective boot provided on the gun head. Thus, when fitted around the gun head 3, the lower member 10 may obtain an improved contact with the gun head 3.

Figure 12:
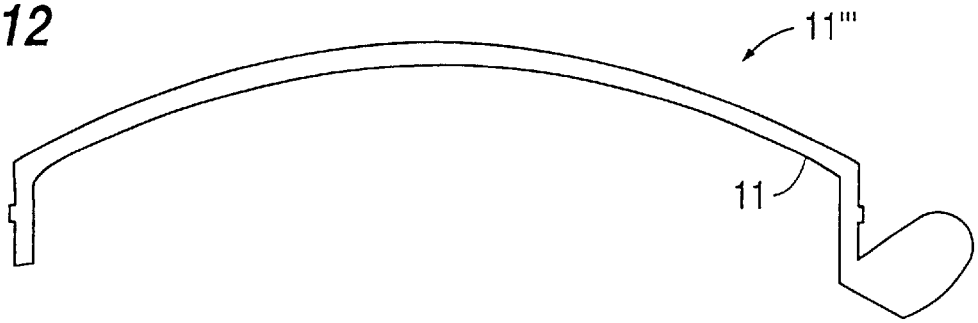

Similarly, as indicated in FIGS. 8–11, the upper member 11 may have similar or technically equivalent space compensating studs, generally denoted by reference number 26. The studs should be so dimensioned that they will easily yield and/or penetrate into the soft protective boot covering the gun head if so provided. FIG. 12 discloses that the top face 11'" of the upper member 11 has a curved configuration along its length. In a first embodiment, the top member shown in FIG. 4 and also in FIG. 13, is labeled with reference number 27 and is formed as a lid with a transparent face portion 27' for viewing therethrough a message on the message card 9. The top member 27 has means in the form of thickened portions 28 on a peripheral skirt portion 29 depending from the transparent face portion 27' designed to engage the bead 11' on the upper member 11. Space is provided between an upper surface of the upper member 11 and a portion of the top member 27 in order that the replaceable message card 9 can be located in such space when the top member 27 and the upper member 11 engage, as illustrated in FIG. 15. FIG. 15 shows how the lower member 10 with its side panels 12, 13 and the first interlocking means 16, 18 is capable of snap locking to the upper member 11.

The top member 27 is suitably provided with a second hinge means 30 engageable with the first hinge means 24 on the upper member 11 for pivotable attachment of the top member 27 to the upper member 11. The second hinge means has a protrusion which is integral with a pin 31, suitably having a slit 32 and a thickened end 33.

Figure 16:
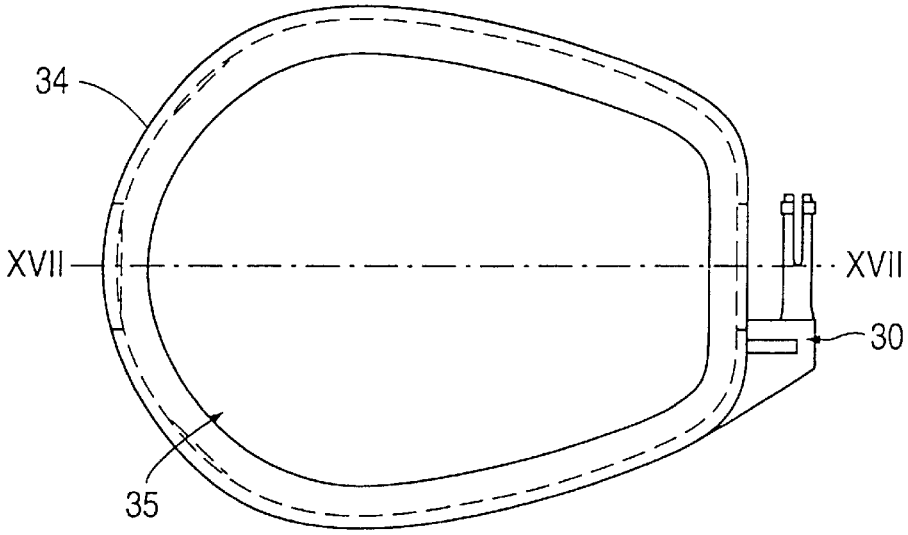
FIG. 16 is a top plan view of a modified top member of the display apparatus formed as an open frame.
Figure 17:
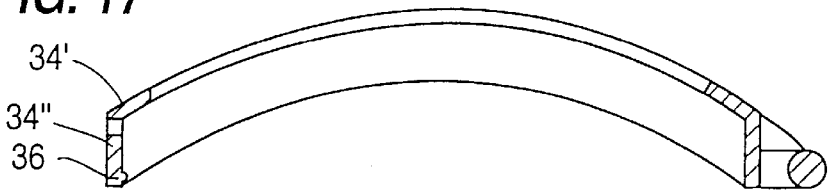
FIG. 17 is section XVII—XVII of FIG. 16.
Figure 18:
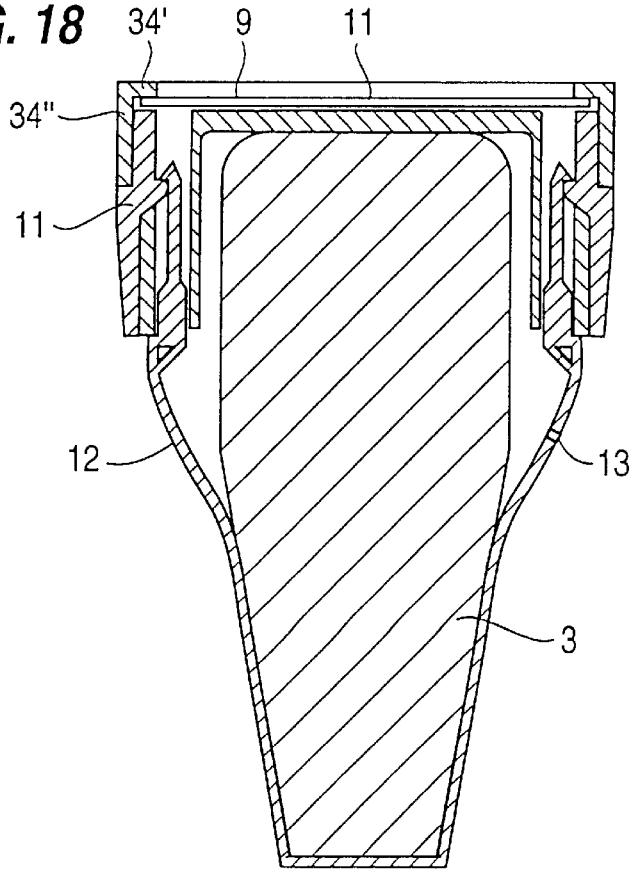
FIG. 18 is a cross section of the display apparatus, according to the present invention fitted onto a filler gun and with a top member according to FIG. 16.

FIGS. 16–20 will now be explained with regard to the differences from what is shown and described in connection with FIGS. 13–15. Instead of the top member 27 being formed as a lid, the embodiment of FIG. 16 shows a top member 34 formed as a frame with open space 35 between opposite sides of the frame. The frame has a first element 34' for laying over a marginal edge portion of a top surface of the upper member 11, as clearly illustrated in FIG. 18 and a second element 34" integral with the first element 34' for releasably engaging upper, peripheral portion of the upper member 11. As similarly shown in FIG. 13, second element may be provided with second portions 36 for releasable engagement with the upper peripheral portion of the upper member. Similarly to that shown in FIGS. 13 and 14, the top member according to FIG. 16 is provided with a second hinge means 30.

The top member of FIG. 16 can be made of a transparent material. Alternatively, it can be made of a translucent material, e.g. of a color that is the same as that of the upper member 11 or a color forming a suitable contrast with the color of member 11.

FIG. 19 is a slight modification of the embodiment of FIG. 16, in that a rear end of the top member has a widened portion, as seen in the longitudinal direction of the top member. The widened portion of the frame is labeled with reference number 37 and is in reality a widened portion of the first element 34' as shown and described in connection with FIGS. 16 and 17. The widened portion 37 of the frame is suitable for carrying information related to type of fuel supplied from the gun, e.g. "PREMIUM."

FIG. 21 is a perspective view of the embodiment according to FIGS. 16–18, and FIG. 22 is a perspective view of the embodiment according to FIGS. 19 and 20.

Figure 6:
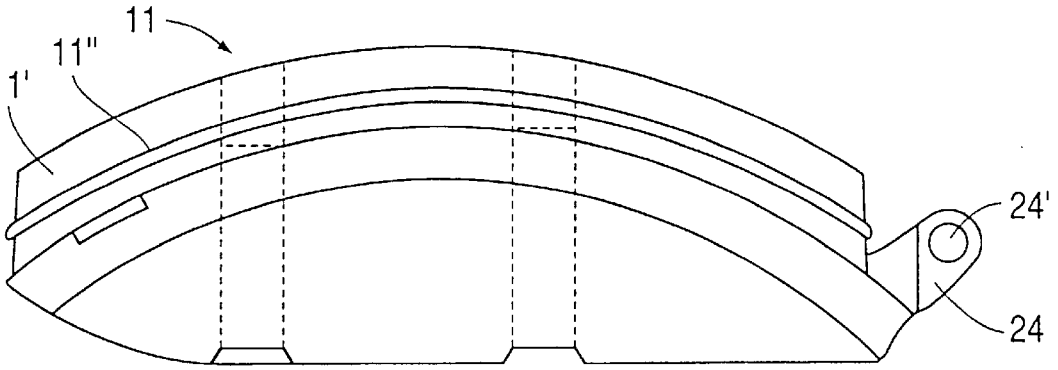
FIG. 6 is a side view of the upper member of the carrying body, according to the present invention.
Figure 7:
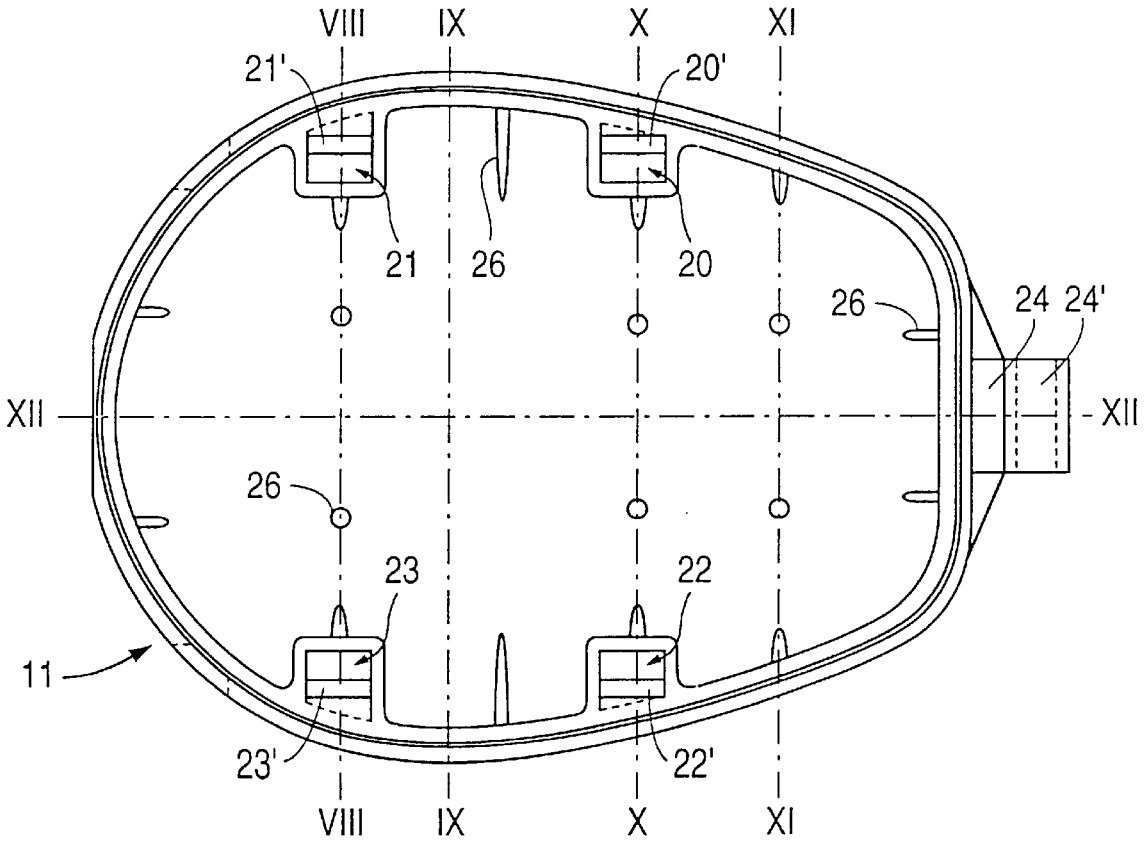
FIG. 7 is a bottom view of the upper member of the carrying body, according to the present invention.
Figure 8:
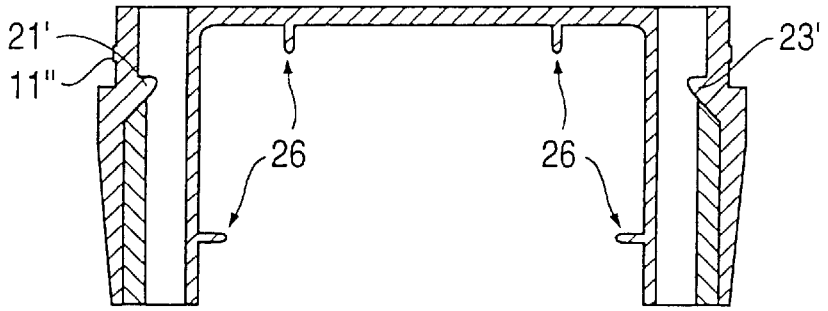
FIGS. 8, 9, 10, 11 and 12 are sectional views VIII, IX, X, XI and XII of FIG. 7.
Figure 9:
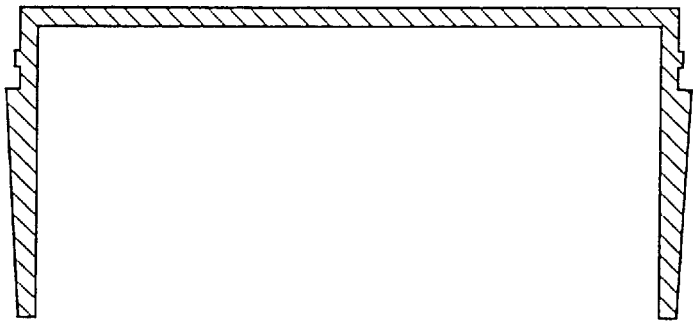
Figure 13:
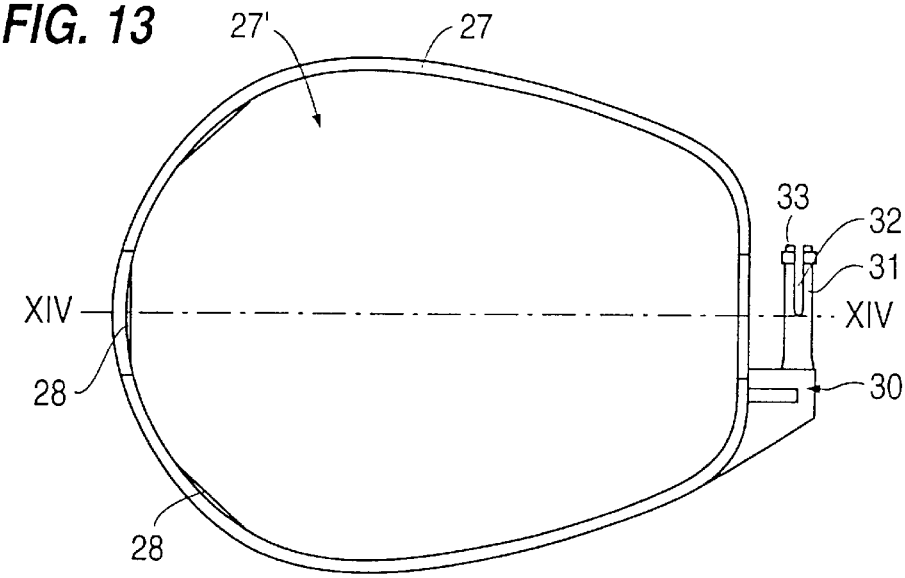
FIG. 13 is a top plan view of a top member of the display apparatus, according to the invention.
Figure 34:
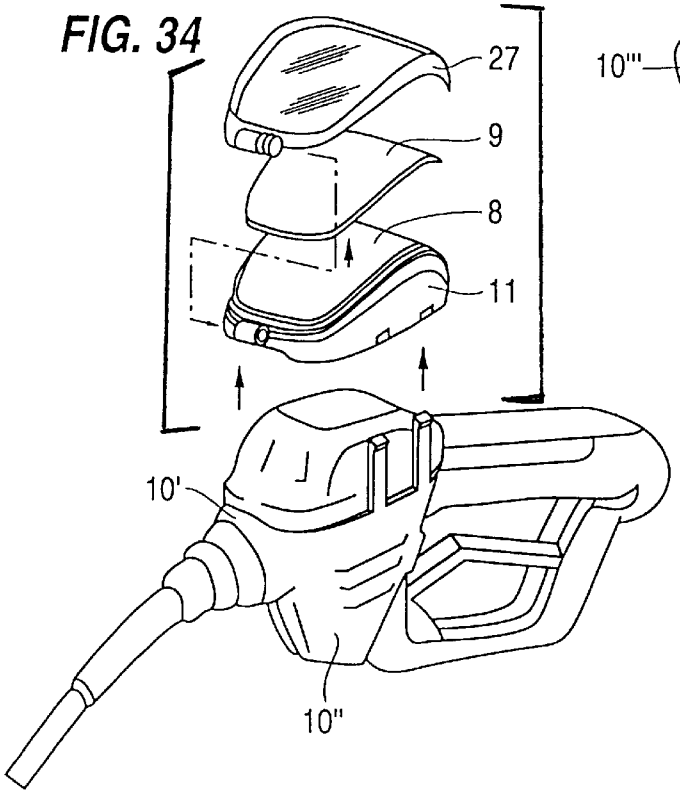

As clearly understood from inspecting in particular FIG. 13 and with reference to FIGS. 6 and 7, the second hinge means in the form of the male member 31 is capable of releasable snap engagement with the female member 24 of the hinge connection between the upper member 11 and its top member, e.g. 27 as shown in FIG. 13 or 34 as shown in FIG. 16, or the modified version of the top member 34 shown in FIG. 19.

Figure 23:
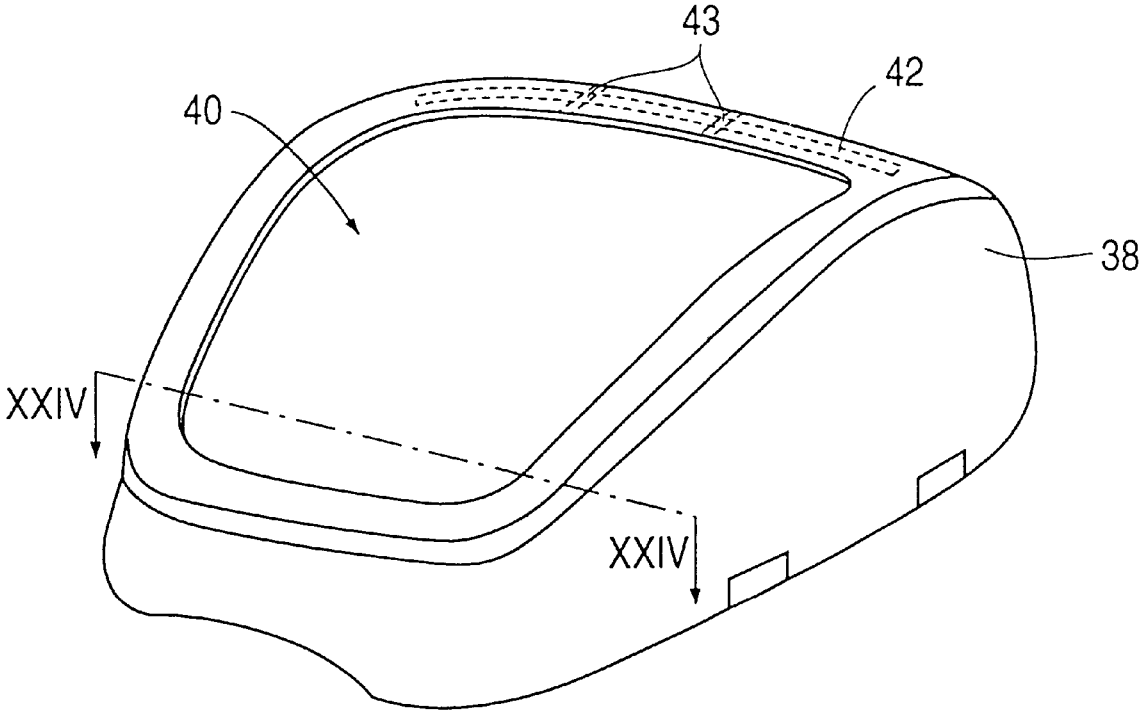
FIG. 23 shows a further embodiment of an upper member of the carrying body of the display apparatus according to the present invention, with an integral frame structure at the top surface of the upper member.
Figure 24:
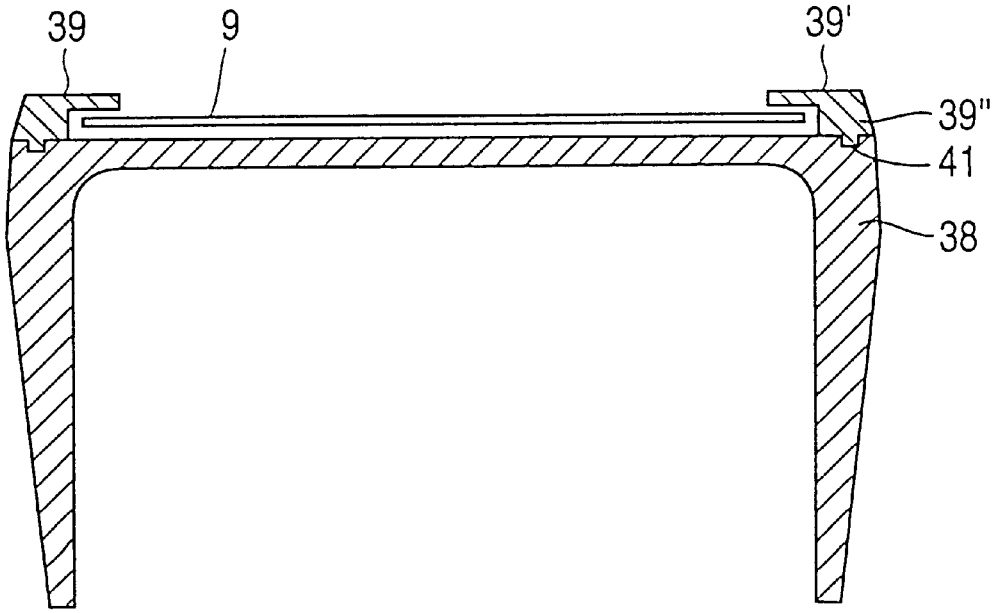
FIG. 24 is cross section XXIV—XXIV of FIG. 23.
Figure 25:
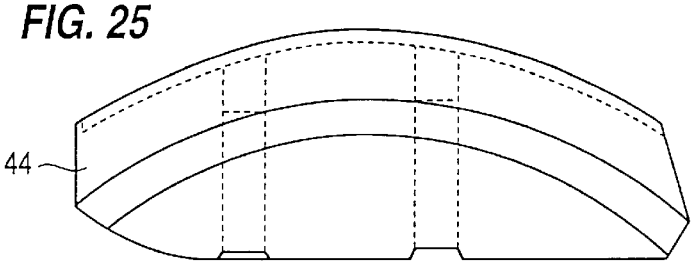
FIGS. 25, 26 and 27 are side view, top view and perspective view, respectively, of a further modified upper member of the carrying body.

A modified version of the upper member 11 is shown in FIGS. 23 and 24, the modified upper member being denoted by reference number 38. The upper member 38 has along its peripheral outline a frame member 39 formed with open space 40 between opposite sides of the frame 39. The frame has a first element 39' located over a marginal top edge portion of the upper surface of the upper member 38, and a second element 39" integral with the first element 39'. The second element is preferably integral with the upper surface of the upper member, e.g. by welding or through the use of suitable adhesive. In order to properly locate the frame 39 onto the upper member 38, e.g. during welding or other operation for joining the two male/female members, a protruding rim and mating recess generally denoted by reference numeral 41 may be provided on the frame 39 and the upper member 38, respectively.

To provide easy insertion of a message card 9 in the space between the upper surface of the upper member 38 and the first element 33' of frame 39, a slot 42 as shown e.g. by dotted lines on FIG. 23 may be provided, the slot being provided suitably in the second element 39" of the frame 39. Alternatively, the first element 39' of the frame 39 may have a removed section 43 to facilitate easy insertion and removal of the message card 9.

An additional modification of the upper member 11 is shown and described with reference to FIGS. 25–29. In this embodiment, the upper member is labeled with reference numeral 44. It has a top surface 44' and along at least a portion of the peripheral edge of the top surface an upwardly extending rim 45. The rim is suitably only a few millimeters high, maybe even less. Means in the form of studs 46 protrude up from the surface 44', the protruding means 46 having a substantially arrow-shaped configuration, a straight upright portion thereof having a height substantially equal to the thickness "d" of the message card 9.

Figure 27:
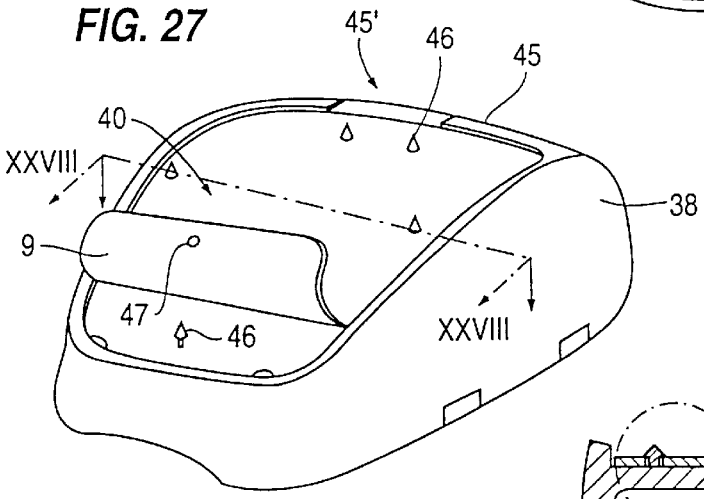
Figure 28:
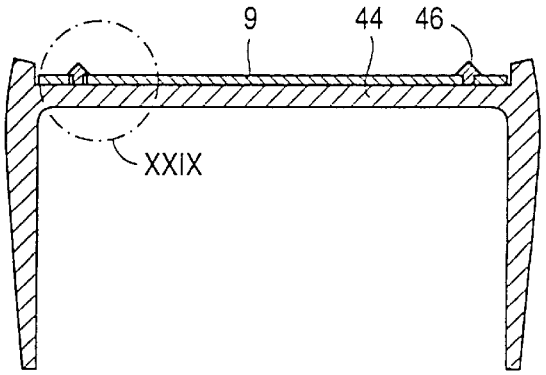
FIG. 28 is cross section XXVII—XXVII of FIG. 27.
Figure 29:
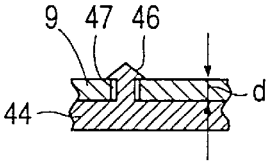
FIG. 29 is an enlarged view XXIX of FIG. 28.

When the message card 9 is positioned inside the inner circumference of the rim 45, as indicated on FIG. 27, holes 47 provided in the message card 9 are brought into snap-like engagement with the arrow-shaped studs 46. Thus, the message card 9 is held suitably in place on the upper member 44. To provide for drainage of any rain water when the gun is located on the fuel pump between filling operations, the rim 45 is suitably provided with opening 45' as indicated in FIG. 27. The opening 45' also provides for easier removal of the message car 9 when it is to be replaced by a new message card.

Figure 26:
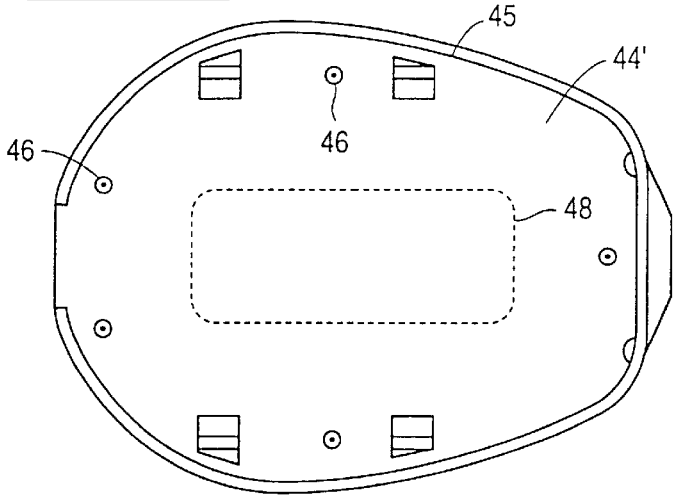

To further secure the message card 9 onto the top surface 44' of the upper member 44, a region of adhesive 48 may be applied to the upper surface 44' of the upper member 44, as indicated in FIG. 26. Alternatively, the adhesive may be available on the rear side of the message card 9 and be of a type which e.g. firmly adheres to the rear side of the message card 9, but not so firmly that it sticks to the upper surface 44' of the upper member 44.

Figure 30:
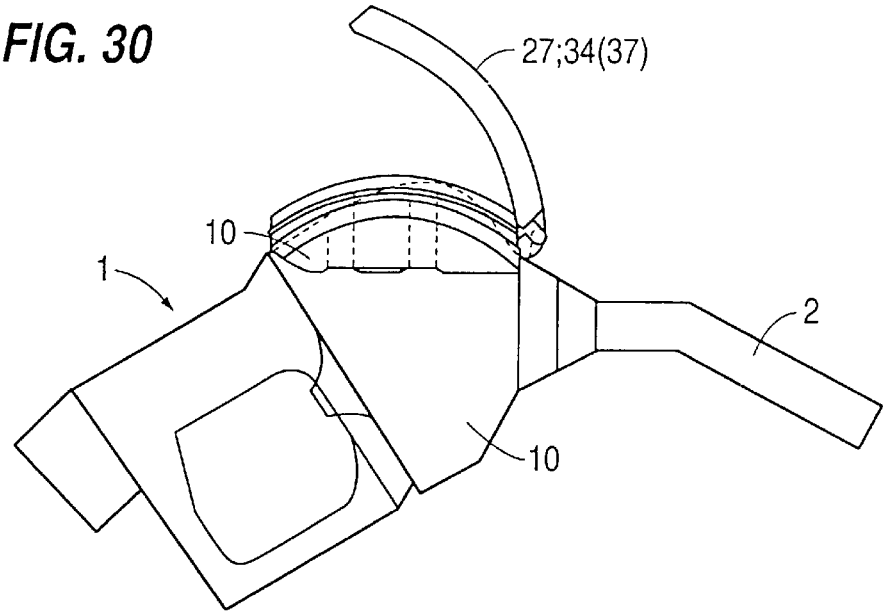
FIG. 30 is a side view of a filler gun with a two-part carrying body fitted thereon and with a pivotally connected top member fitted onto the carrying body.

FIG. 30 illustrates how the display apparatus according to the present invention and in accordance with the embodiments shown and described in connection with FIGS. 1–22 appears in a side view when mounted on a filler gun.

Figure 31:
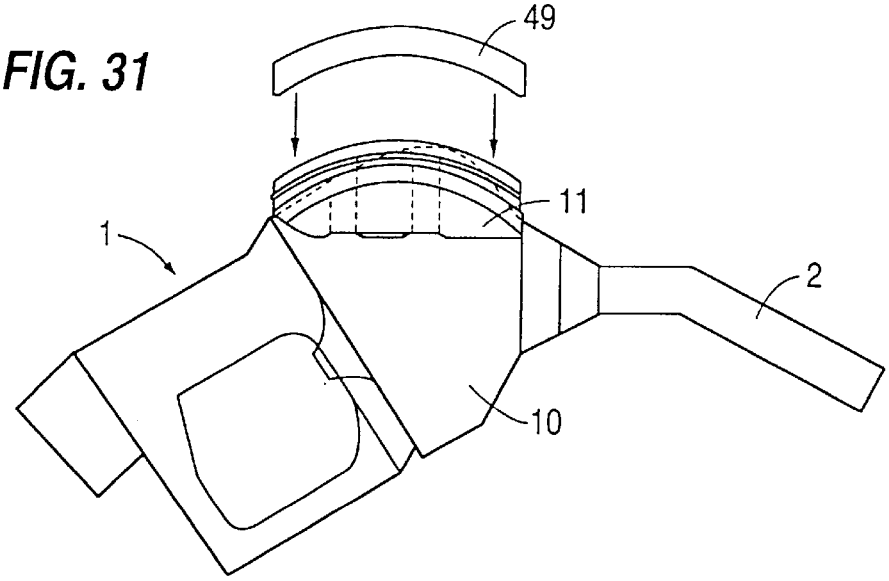
FIG. 31 is a side view of a filler gun with a two-part carrying body fitted thereon, and with a top member engageable with an upper part of the carrying body.

FIG. 31 illustrates that the top member 27; 34 (and 37) could be replaced by a top member 49 having no pivotable connection with the upper member 11. In such a variant, the hinge means 24, 30 are not present.

Figure 32:
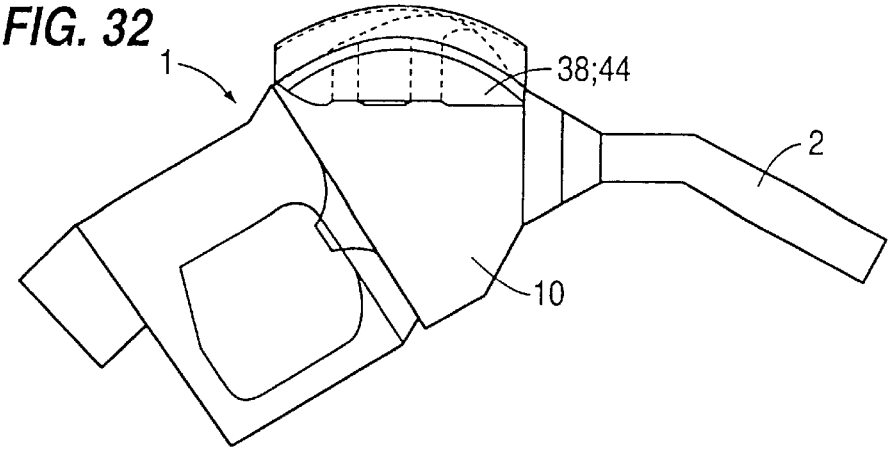
FIG. 32 is a side view of a filler gun with a two-part carrying body fitted thereon, and in accordance with the embodiments shown in FIGS. 23, 24 and 25–29.

FIG. 32 illustrates a side view of the embodiments according to FIGS. 23, 24 and 25–29.

In connection with the description of FIGS. 1 and 2, it should be noted that the side panels 12, 13 at their front region have edges which mate when the panels are brought to lie against the gun head. Until then, the edges are spaced apart. However, in the modified embodiment of FIGS. 33–35, instead of having the lower member 10 of FIG. 1, it is proposed instead to have the two side panels 12, 13 be joined at a front region thereof. Thus, the front region 10" of the two side panels, as indicated in FIG. 34 is brought into engagement with the gun head 3 on the filler gun 1, as illustrated on FIG. 33.

Figure 36:
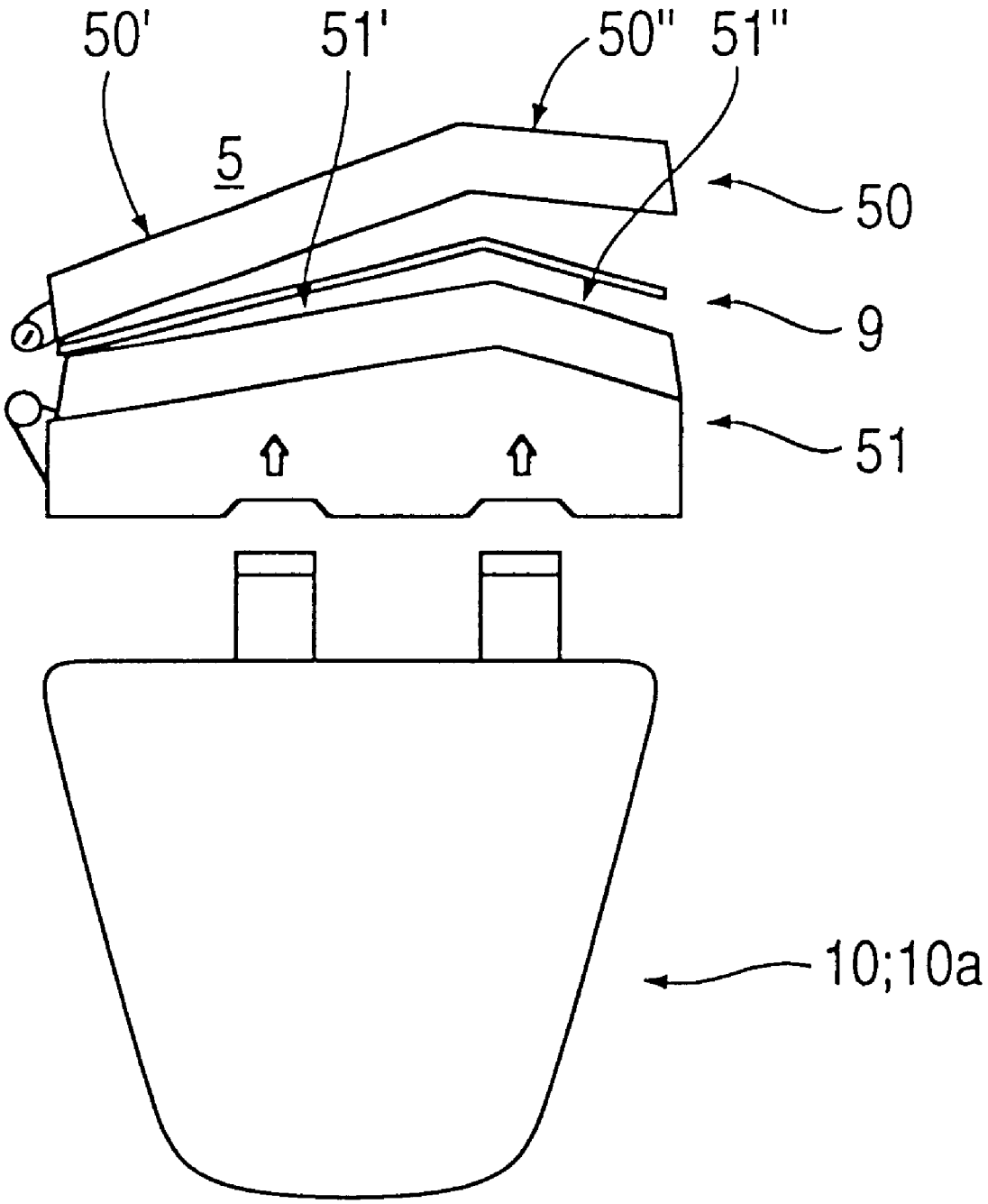
FIG. 36 illustrates a further modification of the two piece carrying body, and the top member.

FIGS. 12, 14, 17, and 20 show that both the upper surface of the upper member may as well as the top member may have a curved configuration along its length. However, it is readily conceivable that the top member, as indicated by reference number 50 in the side view of FIG. 36 could have two substantially planar sections 50' and 50" mutually forming an obtuse angle. Similarly, the upper member, here labeled as 51 could have a top surface of similar configuration seen along its length, i.e. two substantially planar, upper surfaces 51' and 51" forming an obtuse angle. Contrary to prior art carrying bodies for a display apparatus which is removably attachable to the filler gun of a fuel pump, the carrying body, in this particular invention a two-piece carrying body, is suitably made of a substantially hard plastic material. As an example, a suitable material would be e.g. polyamide. In a prototype, polyamide 66 has proved to be a suitable plastic material.

The top member 27; 34 (37); 49; 50 is suitably made of a substantially hard plastic material which may be transparent or non-transparent. A type of material such as polycarbonate has proved to be suitable in connection with a prototype made of the present apparatus. Suitably, the polycarbonate could be e.g. of the make LEXAN®, MAKROLON®, GRILIAMID® or other suitable make.

Figure 33:
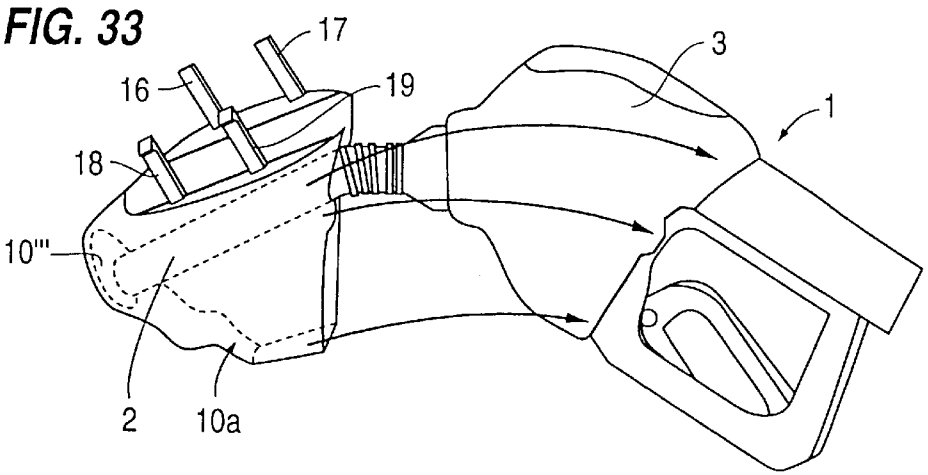
FIGS. 33–35 illustrate fitting of the lower member of the carrying body onto the filler gun when the lower member at its front end region has its side panels integrally joined.
Figure 35:
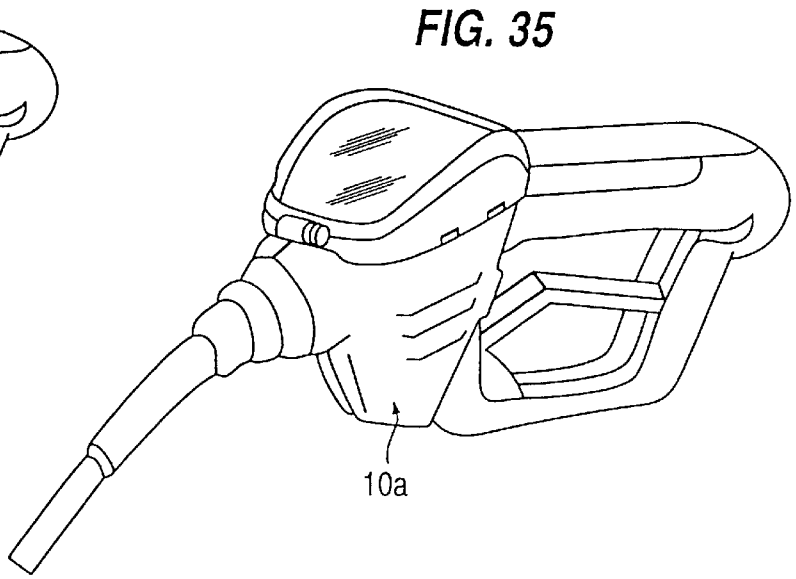

In the embodiment of the lower member **10*a* as described in connection with FIGS. 33–35, when the lower member is to be fitted onto the gun head of the filler gun 1, the rear portions of the side panels 12, 13. may be pushed slightly away from each other to more easily push and enter the lower member 10*a*** onto the filler gun. Although the lower member is made of a substantially hard plastic material, the wall thickness of the lower member is of such dimension that the manipulation of the side panels is possible.

Figure 37:
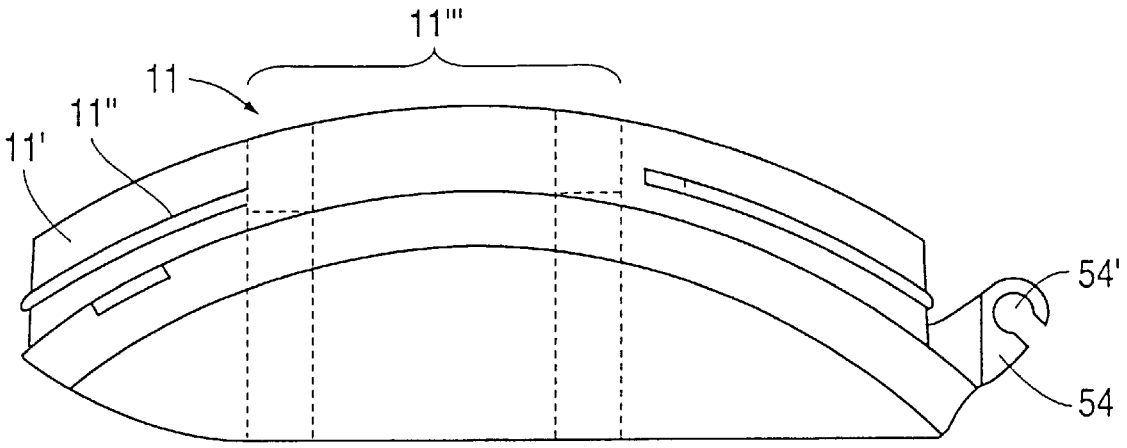
FIGS. 37 and 38 are side and top views of a modified version of the upper member, according to the invention.
Figure 38:
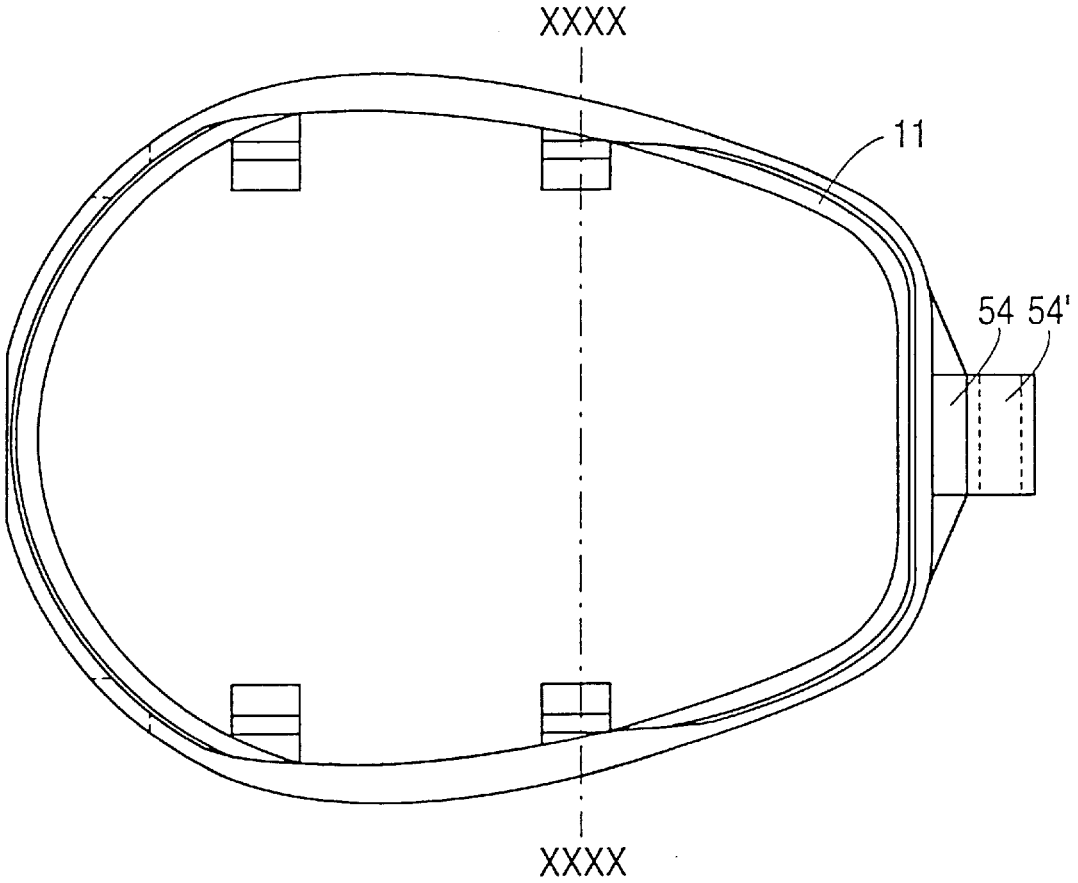
Figure 39:
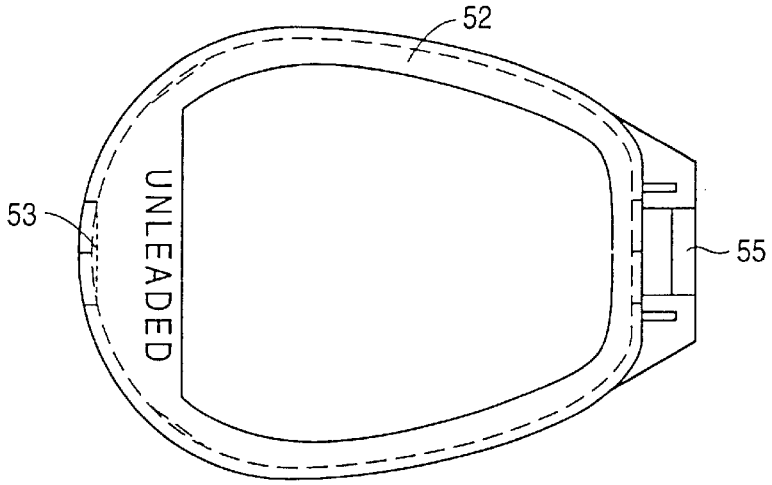
FIG. 39 is a slightly modified version of the frame according to FIG. 19.

Compared with FIGS. 6 and 7, the upper member 11 of FIGS. 37 and 38 have been modified in that a mid-region 11'" of the peripheral portion 11' thereof has its cross-dimension made smaller, inter alia, by removing sections of the peripheral bead 11". At the rear end of the top member 52, e.g. a frame as shown in FIG. 39 has an engagement member 53, e.g. a bead, for engaging said bead 11" at rear end of the upper member 11.

Figure 40:
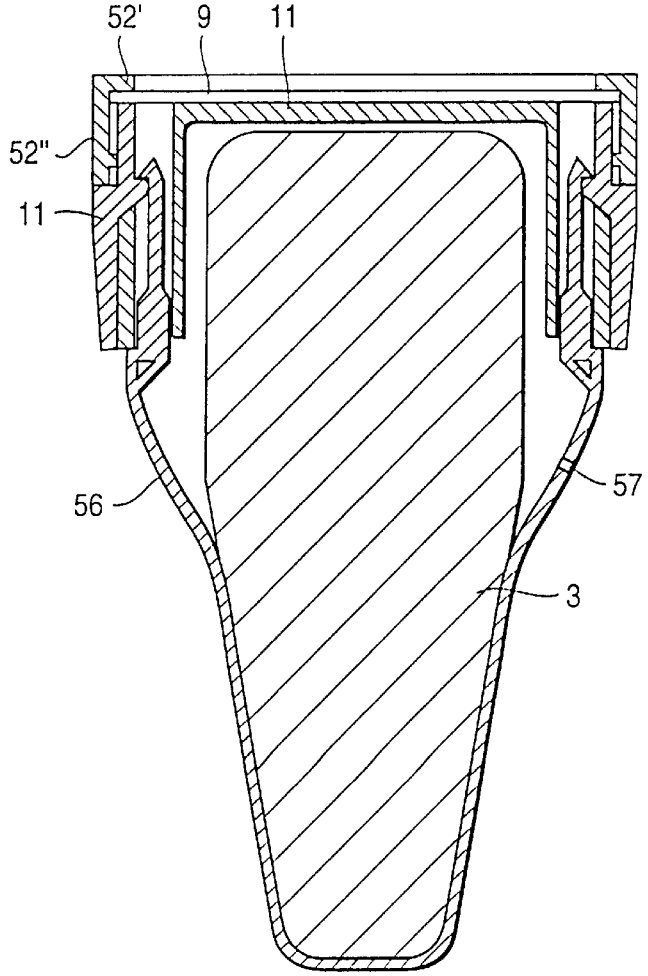
FIG. 40 is a cross-section at XXXX—XXXX of FIG. 38 of the display apparatus according to the present invention, fitted onto a filler gun and with an upper member according to FIGS. 37 and 38.

As shown in FIG. 40, the frame 52 has a horizontal member 52' and a vertical member 52". The vertical member 52" is at midsection 11'" (FIG. 37) of upper member 11 spaced apart from the outer circumference of the upper member 11, thus enabling the squeezing of opposite mid-portions of the frame towards each other to thereby result in movement of the bead 53 in a rearward direction so as to disengage bead 11".

At a forward end of the upper member 11, there is provided a modified first hinge means 54 shown in FIGS. 37 and 38 having a C-shaped cross-section with a recess 54' for receiving in pivotable engagement a modified second hinge 55 located at a front end of top member 52.

Figure 41B:
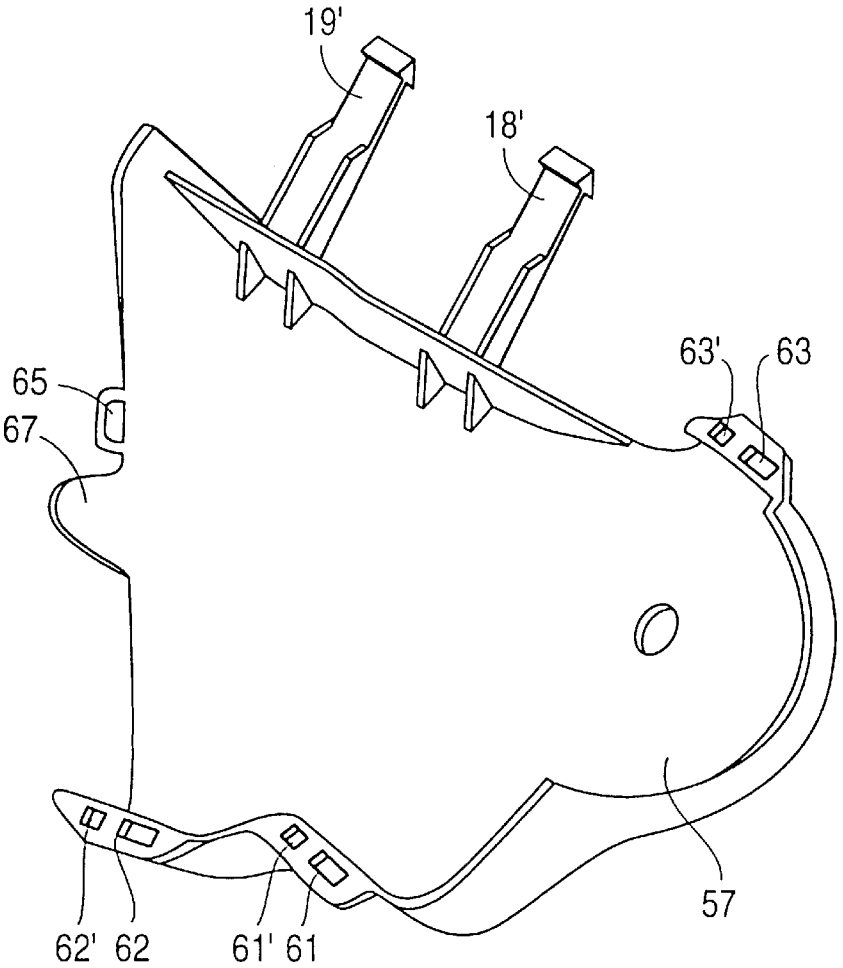
FIGS. 41*a* and 41*b* illustrate separate side panels of a further modified version of the lower member of the display apparatus according to the invention.
Figure 41A:
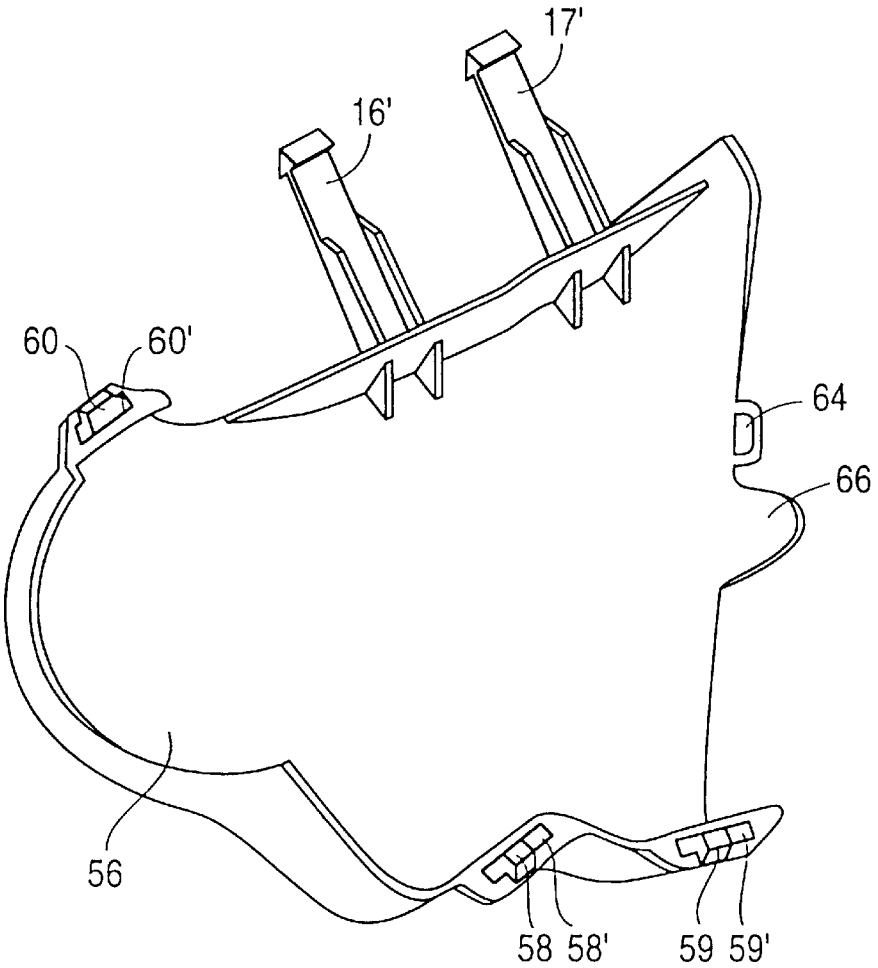
Figure 42:
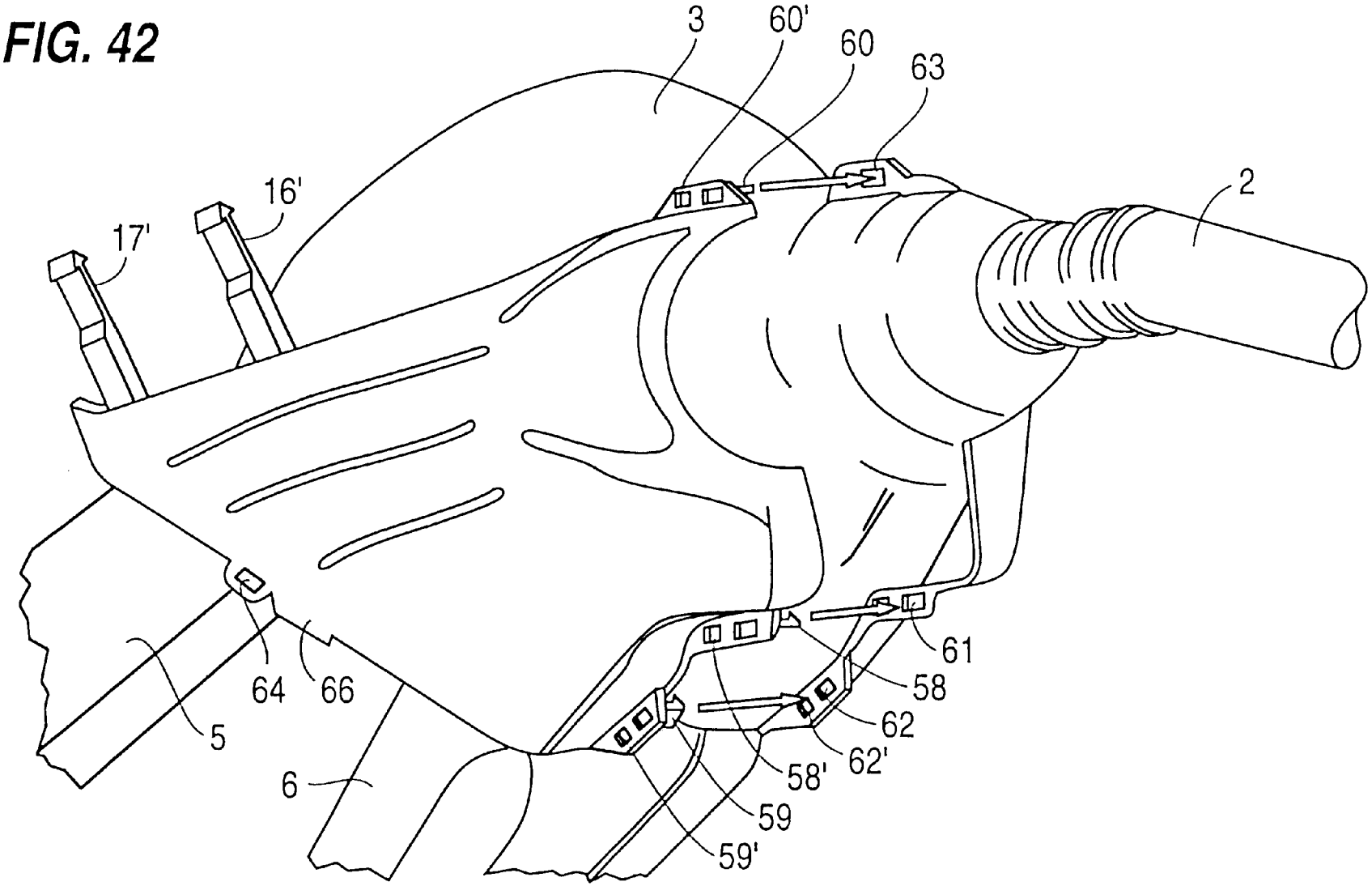
FIG. 42 illustrates installing the side panels of FIGS. 41*a* and 41*b* on a filler gun.
Figure 43:
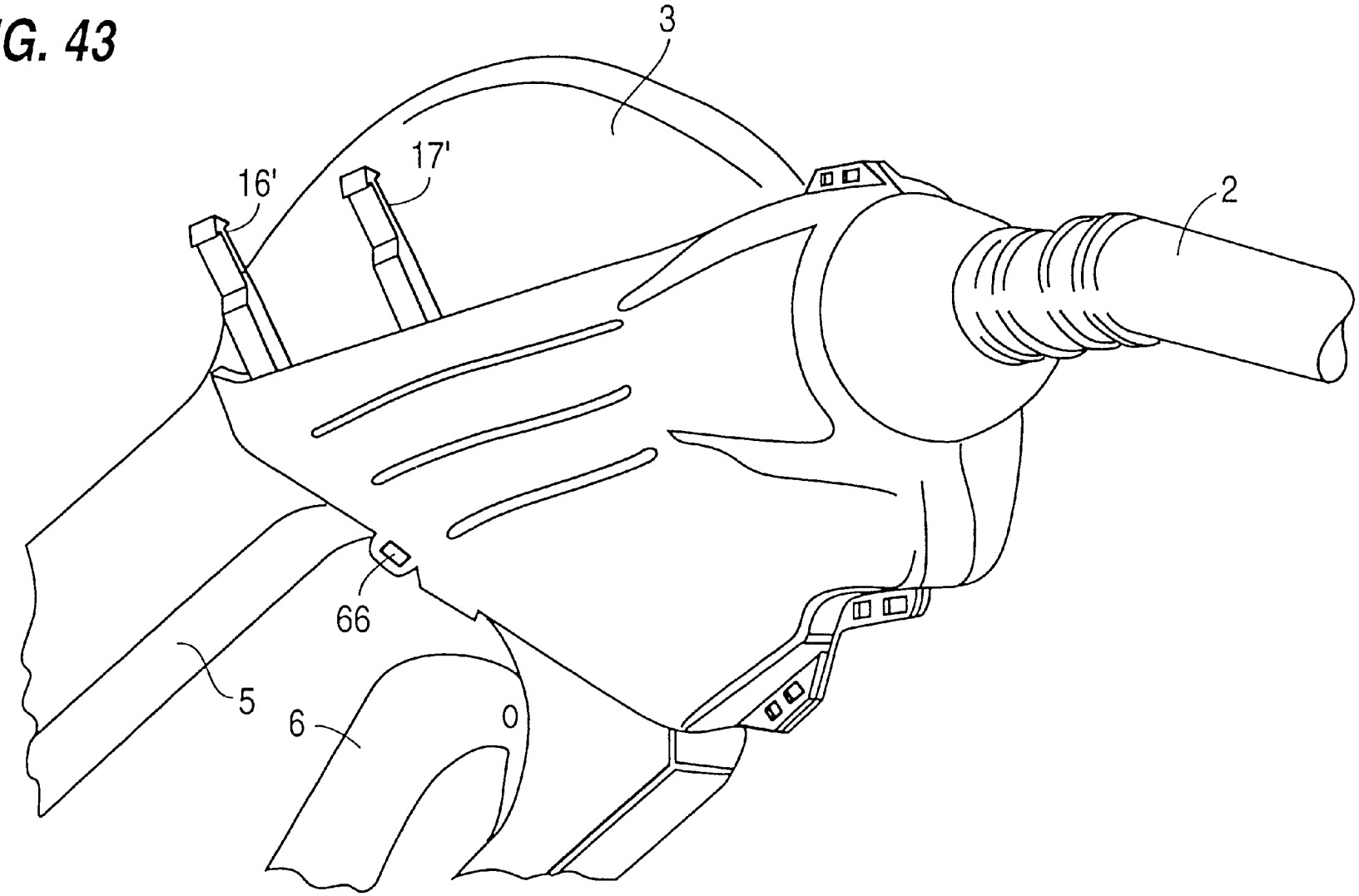
FIG. 43 illustrates the further modified version of the lower member fully installed on a filler gun.
Figure 45:
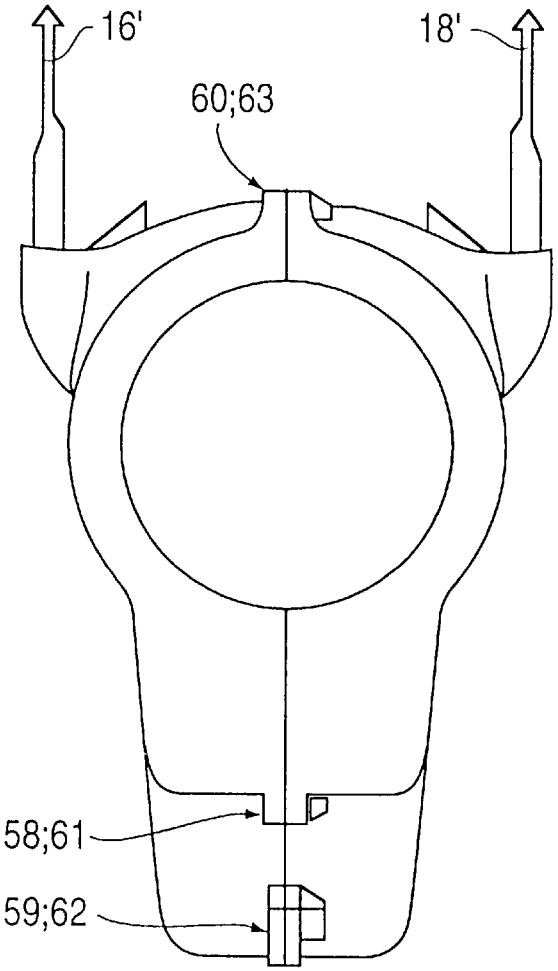
FIG. 45 is a front view of the further modified version of the lower member.
Figure 44:
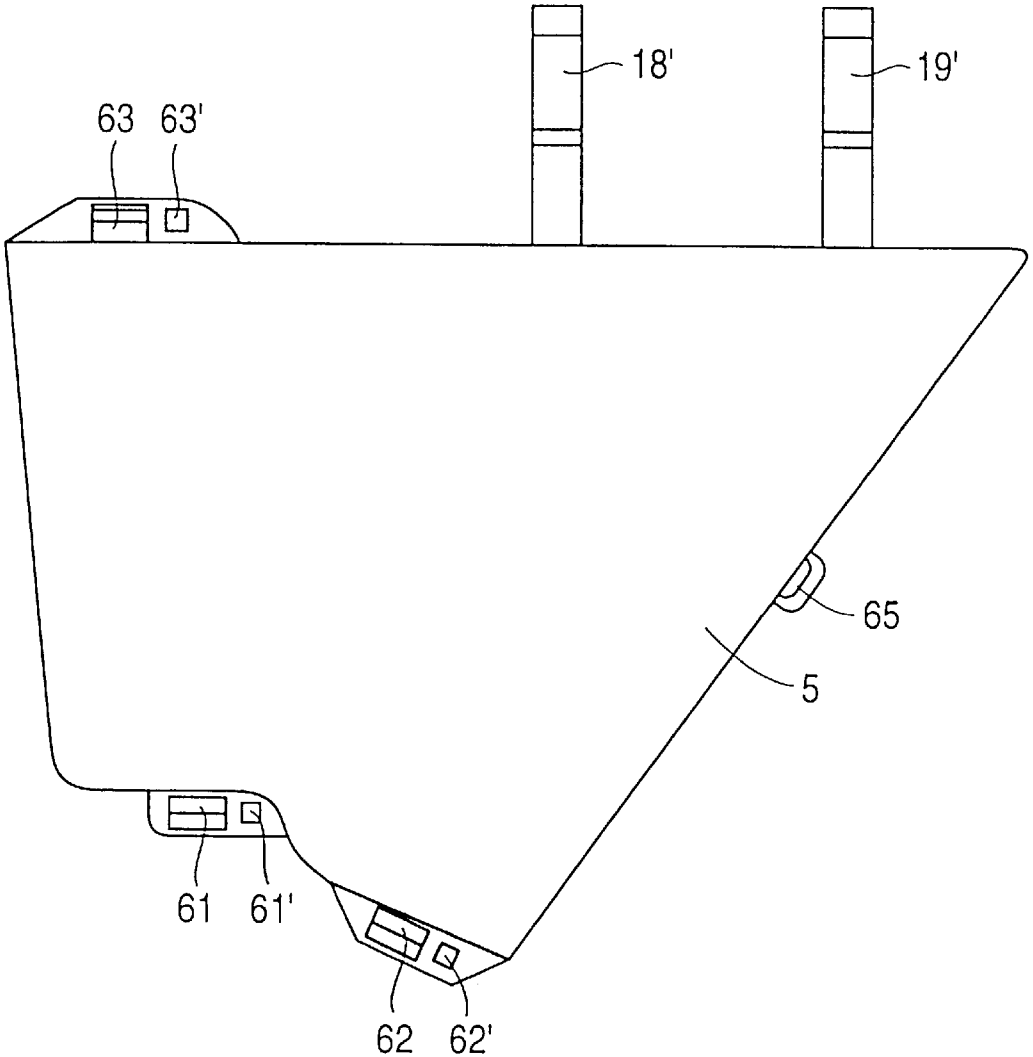
FIG. 44 is an exterior side view of the side panel of FIG. 41*b*.
Figure 46:
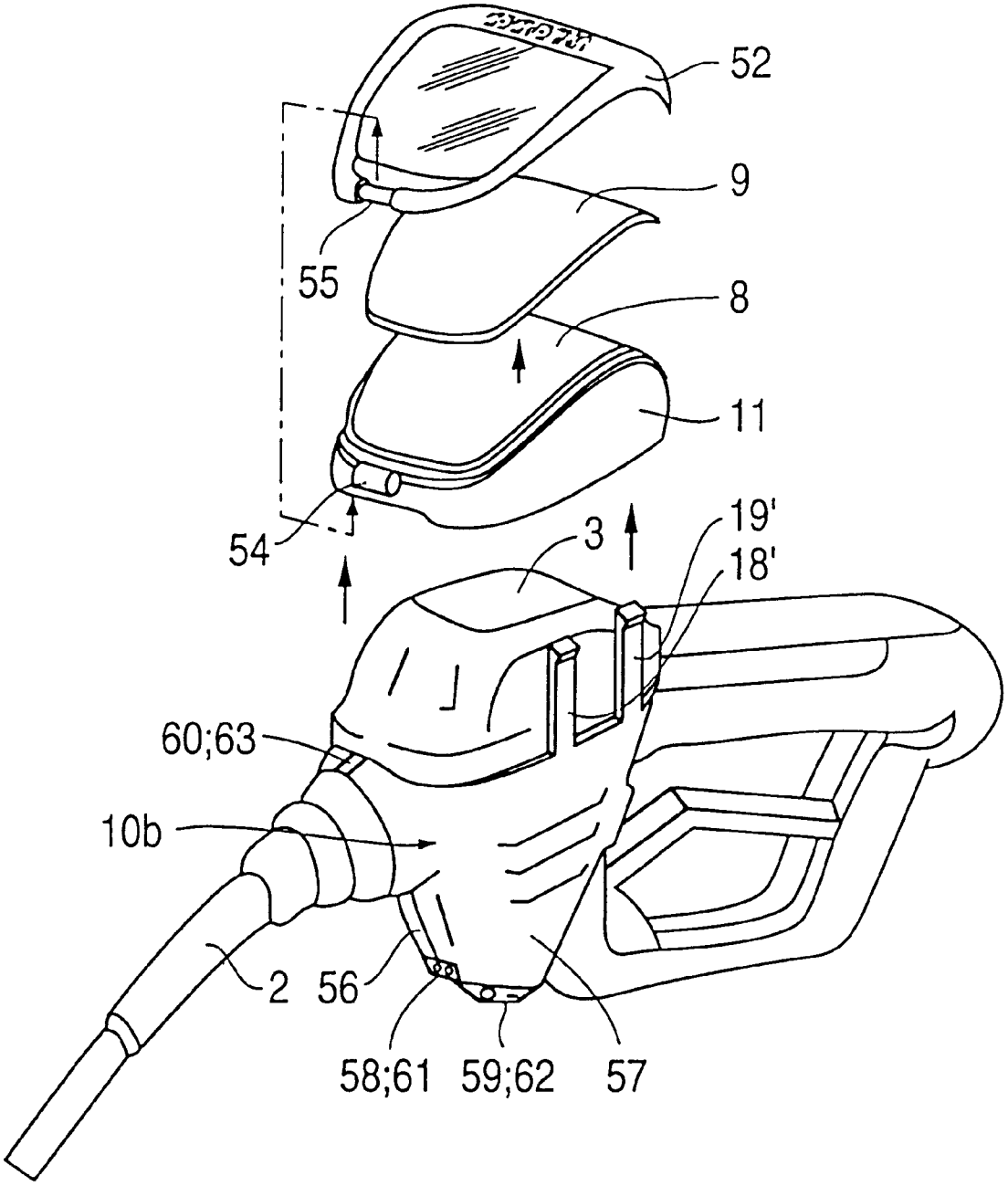
FIG. 46 further illustrates mounting of the modified upper member onto the filler gun and with pivotable engagement of a modified top member with the upper member.

The lower member 10*b* (see FIG. 46) of the display apparatus in its' further modified version comprises two side panels 56 and 57. As illustrated, for example, in FIGS. 41*a* and 41*b* with such two side panels interconnected as shown in FIGS. 42–46. Side panel 56 has suitably a number of first interconnecting means 58, 59 and 60. The number of such means could possibly be fewer, e.g. two or more, for example, four. Side panel 57 has corresponding second interconnecting means 61, 62 and 63. The first interconnecting means 58–60 being suitably male snap-lock means. The second interconnecting means 61–63 are suitably female snap-lock means. Next to the respective interconnecting means may be provided holes 58', 53', 60', 61', 62', 63' as shown in FIG. 42 for inserting conventional self-locking straps in case any of the snap-lock means become defective. At the rear region of the lower member, additional holes 64 and 65 may be provided for engagement with conventional self-locking straps, if so required. Transversely protruding members 66 and 67 are intended for engaging a rear edge region of the gun head. The first interlocking members for engaging the upper member are labeled 16', 17', 18' and 19' in FIG. 41.

With reference to FIG. 7 of the drawings, and also FIG. 26, and further with reference to FIGS. 13, 16, 19, 21, 22, 38, it is first of all seen that the upper members have a peripheral outline of substantially oval form. Further, the top member also has a peripheral outline of substantially oval form.

Suitable dimensions of the top member in the longitudinal direction are in the range of 110–140 millimeters and a maximum transverse dimension in the range of 80–105 millimeters. Preferably, the longitudinal dimension is in the range of about 120–135 millimeters and the maximum transverse dimension is in the range of about 90–100 millimeters.

With the present invention, it is possible to design a display apparatus having a carrying body with an upper member suitable for any type of filler gun, and a lower member which is selected from a set of lower members, each such member "tailor-made" to fit a particular type or make of filler gun. Thus, using an upper member which has the same, display area for any type of filler message gun used, it is possible to standardize the configuration of the message card.

Although preferred embodiments of the present invention have been shown and described, it will be possible for a person skilled in the art to modify the present display apparatus, and the scope of the present invention is therefor only to be limited by the features of the attached patent claims and technical equivalents thereof. Although the invention has been specifically described and claimed with reference to the use on the filler gun of a fuel pump, it will be readily appreciated that the present invention could be used on other types of fluid filler guns, such as typically found at service stations for automobiles, and that such use would also lie within the meaning of technical equivalence.

What is claimed is:

1. Display apparatus attachable to a fluid pump filler gun for displaying a replaceable graphic message in the form of a display card which is viewable by the user of the filler fun, comprising:

a supporting surface for the display card having a substantially continuous peripheral rim extending substantially at a right angle to the supporting surface and having on its outwardly facing surface at least one elongate protruding rib, a protective cover for said supporting surface defining a central portion which permits viewing of the display card on said supporting surface, said cover having a peripheral rim portion for engaging said peripheral rim on said supporting surface to thereby secure said cover onto said supporting surface, said peripheral rim on substantially opposite sides of said supporting surface being interrupted to thereby enable the rim on said cover to move past the rim on said supporting surface thereby facilitating removal and replacement of said resilient cover with respect to said supporting surface.

2. The display apparatus of claim 1 in which said central portion of said protective cover is an open portion.

3. Display apparatus removably attachable to a, fluid pump filler gun, said filler gun including a gun nozzle, a gun head covered by a protective boot, said gun head having internally located valve means with valve outlet means communicating with said nozzle and valve inlet means communicating with fluid supply means extending through a handle of the gun, said handle having lever means operatively connected to said valve means, said apparatus supporting on its upper surface means for displaying a graphic message viewable by a gun user, comprising:

a carrying body for said graphic message, said body while attached to the filler gun, without said protective boot having been removed, being adapted to fit over the filler gun, said carrying body including a display surface for said message, said carrying body comprising a lower member, and an upper member releasably engageable with said lower member, said lower member having two side panels and means for interconnecting the side panels, said lower member, when the two side panels are brought to lie against said gun head and its protective boot substantially fitting around a lower part of the gun head, and said side panels having at a top region thereof first interlocking means, said upper member being formed as cap means to fit over an upper part of the gun head and its protective boot, and having second interlocking means for releasably engaging said first interlocking means on said lower member, and a top member releasably engageable with said upper member, space being provided between an upper face of said upper member and a portion of said top member for locating a replaceable message card when said top member and said upper member engage, wherein said interconnecting means is a bottom element attached to said panels by connecting means, and wherein said panels, said bottom element and said first interlocking means of said lower member are formed as an integrally made structure.

4. Display apparatus removably attachable to a fluid pump filler gun, said filler gun including a fuel gun nozzle, a gun head having internally located valve means with valve outlet means communicating with said nozzle and valve inlet means communicating with fluid supply means extending through a handle of the gun, said handle having lever means operatively connected to said valve means, said apparatus supporting on its upper surface means for displaying a graphic message viewable by a gun user, comprising:

a carrying body for said graphic message, said body while attached to the filler gun being adapted to fit over the filler gun to extend from approximately the junction of the gun nozzle with the gun head to approximately the junction of the gun head with a forward end of the handle, said carrying body including a display surface for said message, said display surface, when said carrying body is attached to the filler gun, extending longitudinally along the filler gun from approximately the junction of the gun head with the nozzle to approximately the junction of the gun head with the forward end of the handle of the gun, said carrying body comprising a lower member, and an upper member releasably engageable with said lower member, said lower member having two side panels and means for interconnecting the side panels, said lower member, when the two side panels are brought to lie against said gun head substantially fitting around a lower part of the gun head, and said side panels having at a top region thereof first interlocking means, and said upper member being formed as cap-like means to fit over an upper part of the gun head, and having second interlocking means for releasably engaging said first interlocking means on said lower member, said upper member having an upper surface for locating a replaceable message card, said upper surface having along at least a portion of its peripheral edge an upwardly extending rim, and means protruding up from said top surface for releasably engaging holes in said message card, wherein said interconnecting means is a bottom element attached to said panels by connecting means, and wherein said panels, said bottom element and said first interlocking means of said lower member are formed as an integrally made structure.

5. Display apparatus removably attachable to a fluid pump filler gun, said filler gun including a gun nozzle, a gun head covered by a protective boot, said gun head having internally located valve means with valve outlet means communicating with said nozzle and valve inlet means communicating with fluid supply means extending through a handle of the gun, said handle having lever means operatively connected to said valve means, said apparatus supporting on its upper surface means for displaying a graphic message readily viewable by a gun user, comprising:

a carrying body for said graphic message, said body while attached to the filler gun, without said protective boot having been removed, being adapted to fit over the filler gun to extend from approximately the junction of the gun nozzle with the gun head to approximately the junction of the gun head with a forward end of the handle, said carrying body including a display surface for said message, said display surface, when said carrying body is attached to the filler gun, extending longitudinally along the filler gun from approximately the junction of the gun head with the nozzle to approximately the junction of the gun head with the forward end of the handle of the gun, said carrying body comprising a lower member, and an upper member releasably engageable with said lower member, said lower member having two side panels and means for interconnecting the side panels, said lower member, when the two side panels are brought to lie against said gun head and its protective boot substantially fitting around a lower part of the gun head, and said side panels having at a top region thereof first interlocking means, and said upper member being formed as a cap-like means to fit over an upper part or the gun head, and having second interlocking means for releasably engaging said first interlocking means on said lower member, said upper member having an upper surface for locating a replaceable message card, said upper surface having along at least a portion of its peripheral edge an upwardly extending rim, and means protruding up from said upper surface for releasably engaging holes in said message card, wherein said interconnecting means is a bottom element attached to said panels by connecting means, and wherein said panels, said bottom element and said first interlocking means of said lower member are formed as an integrally made structure.

* * * * *